US010069223B2

(12) United States Patent
Sabo et al.

(10) Patent No.: US 10,069,223 B2
(45) Date of Patent: Sep. 4, 2018

(54) ELECTRICAL CABLE CONNECTOR

(71) Applicant: FCI USA LLC, Etters, PA (US)

(72) Inventors: James M. Sabo, Marysville, PA (US); Christopher S. Gieski, Gardners, PA (US); Charles Copper, Hummelstown, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 15/317,841

(22) PCT Filed: Jun. 9, 2015

(86) PCT No.: PCT/US2015/034857

§ 371 (c)(1),
(2) Date: Dec. 9, 2016

(87) PCT Pub. No.: WO2015/191549

PCT Pub. Date: Dec. 17, 2015

(65) Prior Publication Data

US 2017/0117645 A1 Apr. 27, 2017

Related U.S. Application Data

(60) Provisional application No. 62/011,488, filed on Jun. 12, 2014.

(51) Int. Cl.
*H01R 12/53* (2011.01)
*H01R 4/02* (2006.01)
(Continued)

(52) U.S. Cl.
CPC ..... *H01R 12/53* (2013.01); *H01R 4/023* (2013.01); *H01R 12/57* (2013.01); *H01R 12/585* (2013.01);
(Continued)

(58) Field of Classification Search
CPC . H01R 4/23; H01R 4/24; H01R 12/00; H01R 12/16; H01R 12/53; H01R 12/57;
(Continued)

(56) References Cited

U.S. PATENT DOCUMENTS 3,866,996 A * 2/1975 Elkins ..... H01R 4/2429 439/404
3,963,300 A * 6/1976 Patton ..... H01R 31/02 439/638

(Continued)

FOREIGN PATENT DOCUMENTS

DE 102010034790 A1 2/2012
EP 0807995 A1 11/1997
EP 2453526 A1 5/2012

OTHER PUBLICATIONS

International Search Report and Written Opinion for International Application No. PCT/US2015/034857 dated Aug. 4, 2015.

*Primary Examiner* — Xiaoliang Chen
(74) *Attorney, Agent, or Firm* — Wolf, Greenfield & Sacks, P.C.

(57) ABSTRACT

An electrical cable connector is provided that can be configured to be mounted to a printed circuit board. The electrical connector includes a connector housing, and a pair of electrical terminals (38,40) that are configured to be mounted to electrical cables (22,30). The electrical terminals (38,40) can be identical to each other in one example.

18 Claims, 26 Drawing Sheets

(51) Int. Cl.
*H01R 43/02* (2006.01)
*H01R 43/20* (2006.01)
*H01R 12/57* (2011.01)
*H01R 12/58* (2011.01)

(52) U.S. Cl.
CPC ..... *H01R 43/0207* (2013.01); *H01R 43/0256* (2013.01); *H01R 43/20* (2013.01)

(58) Field of Classification Search
CPC ..... H01R 12/72; H01R 13/00; H01R 13/02; H01R 13/42; H01R 13/56; H01R 13/58; H01R 13/64; H01R 13/115; H01R 13/193; H01R 13/514; H01R 13/629; H01R 13/646
USPC ..... 174/267; 439/78, 101, 260, 267, 374, 439/377, 395, 404, 403, 417, 445, 456, 439/502, 511, 581, 637, 660, 701, 861, 439/941
See application file for complete search history.

(56) References Cited

U.S. PATENT DOCUMENTS 4,066,317 A * 1/1978 Bierenfeld ..... H01R 4/2429 439/355
4,066,320 A * 1/1978 Goodrich ..... H01R 4/2429 439/392
4,127,312 A * 11/1978 Fleischhacker ..... H01R 4/2429 439/403
4,684,192 A * 8/1987 Long ..... H01R 13/629 439/152
4,782,244 A * 11/1988 Wakimoto ..... H02K 5/225 307/116
4,969,924 A * 11/1990 Suverison ..... G02B 6/3817 385/78
5,064,384 A * 11/1991 Weaver ..... H01R 9/2675 439/511
5,071,219 A * 12/1991 Yurtin ..... G02B 6/3878 385/78
5,119,455 A * 6/1992 Jennings ..... G02B 6/3825 385/138
5,173,058 A * 12/1992 Broeksteeg ..... H01R 13/193 439/267
5,240,430 A * 8/1993 Soes ..... H01R 12/592 439/260
5,890,926 A * 4/1999 Pauza ..... H01R 13/562 439/445
6,050,842 A * 4/2000 Ferrill ..... H01R 4/2429 439/404
6,050,845 A * 4/2000 Smalley, Jr. ..... H01R 4/2433 439/395
6,280,209 B1 * 8/2001 Bassler ..... H01R 12/724 439/101
6,565,378 B1 * 5/2003 Sawayanagi ..... H01R 13/42 439/456
6,923,661 B1 * 8/2005 Bogiel ..... H01R 12/7088 439/78
2004/0053532 A1 * 3/2004 Jones ..... H01R 4/242 439/581
2006/0035531 A1 * 2/2006 Ngo ..... H01R 13/514 439/701
2008/0153327 A1 6/2008 Weber et al.
2009/0176402 A1 * 7/2009 Honda ..... H01R 4/02 439/377
2010/0297887 A1 * 11/2010 Chen ..... H01R 13/514 439/660
2012/0034820 A1 * 2/2012 Lang ..... H01R 13/65802 439/660
2012/0315787 A1 * 12/2012 Wiest ..... H01L 31/05 439/502
2013/0337694 A1 * 12/2013 Chen ..... H01R 12/721 439/637
2015/0038003 A1 * 2/2015 Sabo ..... H01R 4/2433 439/401
2016/0072200 A1 * 3/2016 Sabo ..... H01R 4/2425 439/395

* cited by examiner

ELECTRICAL CABLE CONNECTOR

The present application is a U.S. national stage filing under 35 U.S.C. § 371 based on International Application No. PCT/US2015/034857 entitled "ELECTRICAL CABLE CONNECTOR", filed Jun. 9, 2015, which claims priority under 35 U.S.C. § 119(e) to U.S. Provisional Patent Application No. 62/011,488, filed Jun. 12, 2014, which are hereby incorporated by reference in their entireties.

BACKGROUND

Electrical cable connectors typically include at least one electrical connector having a dielectric or electrically insulative connector housing and at least one electrical terminal supported by the connector housing. The electrical terminal includes at least one mounting end configured to be mounted to a complementary electrical component, such as a printed circuit board. The electrical connector assemblies further include at least one electrical cable that is configured to be mounted to the electrical contact, thereby placing the electrical cable in electrical communication with the complementary electrical component when the electrical terminal is mounted to the electrical component. The electrical cable can be a power connector configured to transmit electrical power from a remote component to which the electrical cable is mounted, to the electrical connector, which then transmits the power to the complementary electrical component.

SUMMARY

An electrical cable connector an include an electrically insulative connector housina, a first electrical cable including a first electrical conductor, and a second electrical cable including a second electrical conductor. The cable connector can further include a first electrical terminal including a first terminal body capable of being mounted to the first electrical conductor, and a first at least one mounting portion that includes a plurality of mounting terminals that extend out from the first terminal body and out the connector housing in a first direction. The first at least one mounting portion can be configured to be mounted to a printed circuit board. The cable connector can further include a second electrical terminal including a second terminal body capable of being mounted to the second electrical conductor, and a second at least one mounting portion that extends out from the second terminal body and out the connector housing in the first direction. The second at least one mounting portion can be configured to be mounted to a printed circuit board.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1A:
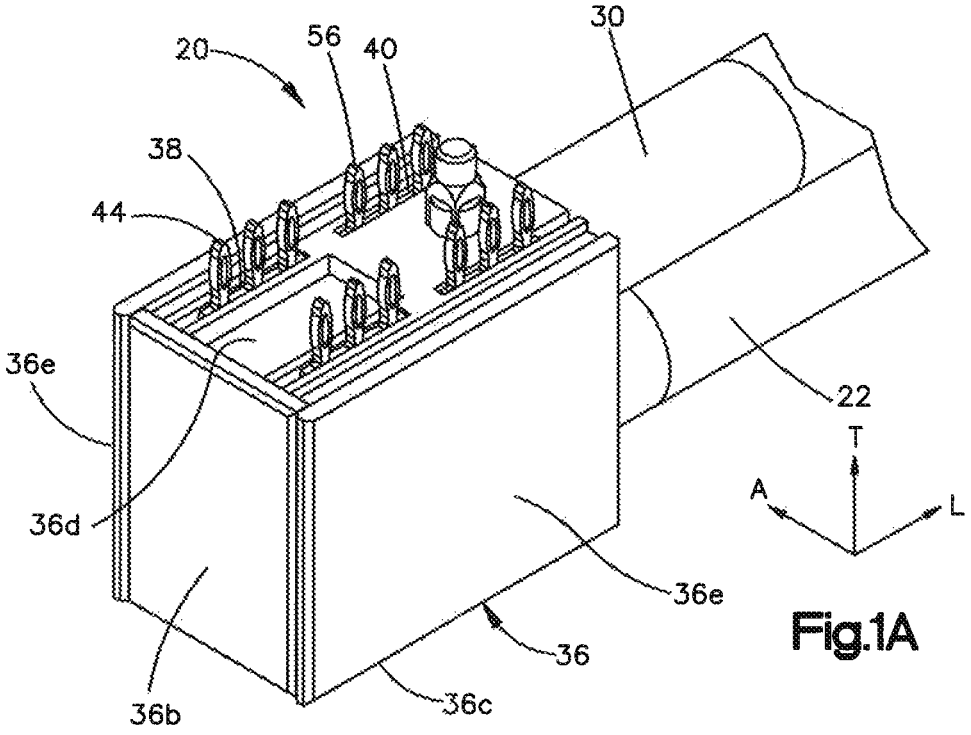
FIG. 1A is a perspective view of an electrical cable connector constructed in accordance with one embodiment including a connector housing, first and second electrical terminals, and first and second electrical cables.
Figure 1B:
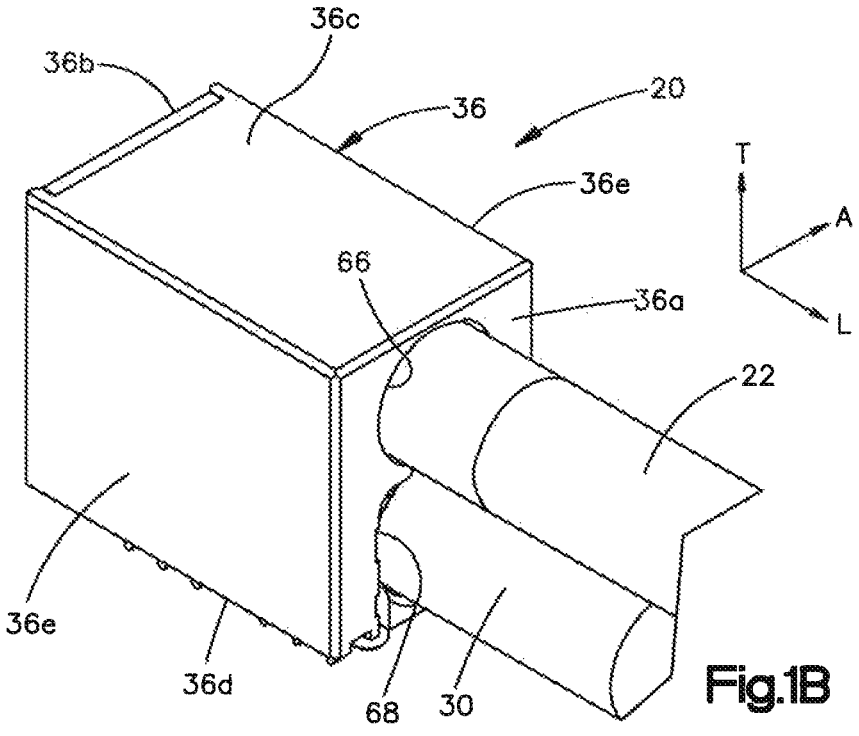
FIG. 1B is another perspective view of the electrical cable connector illustrated in FIG. 1A.
Figure 2B:
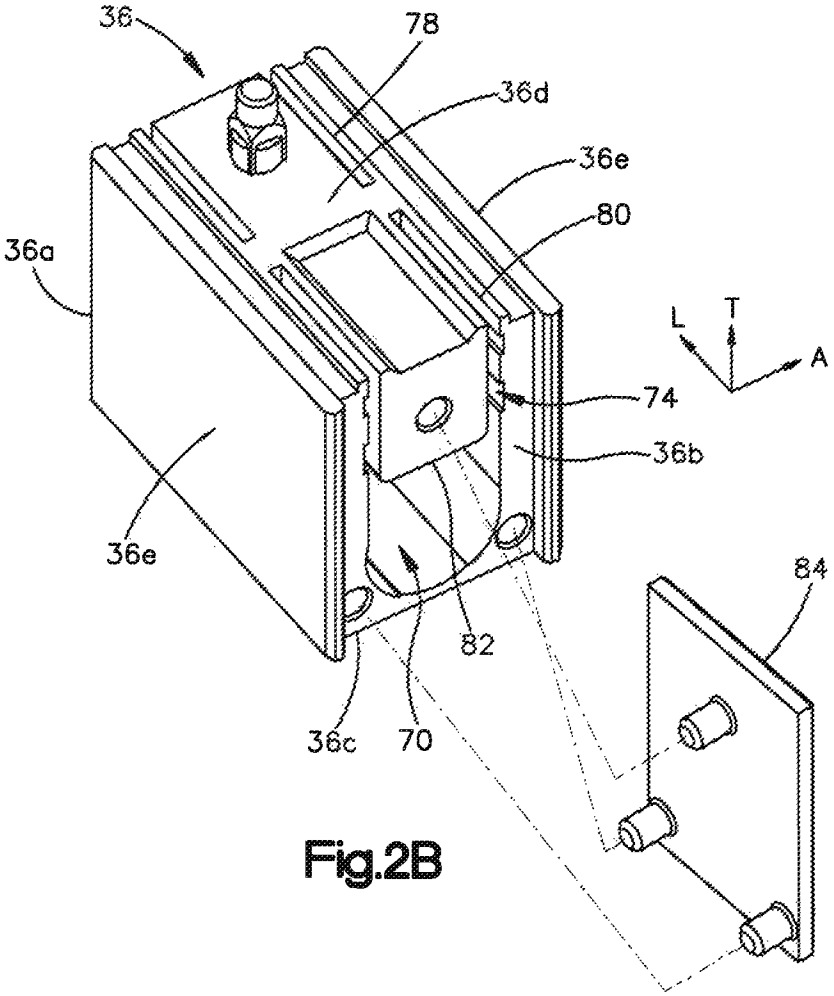
FIG. 2B is another perspective view of the connector housing illustrated in FIG. 2A.
Figure 2A:
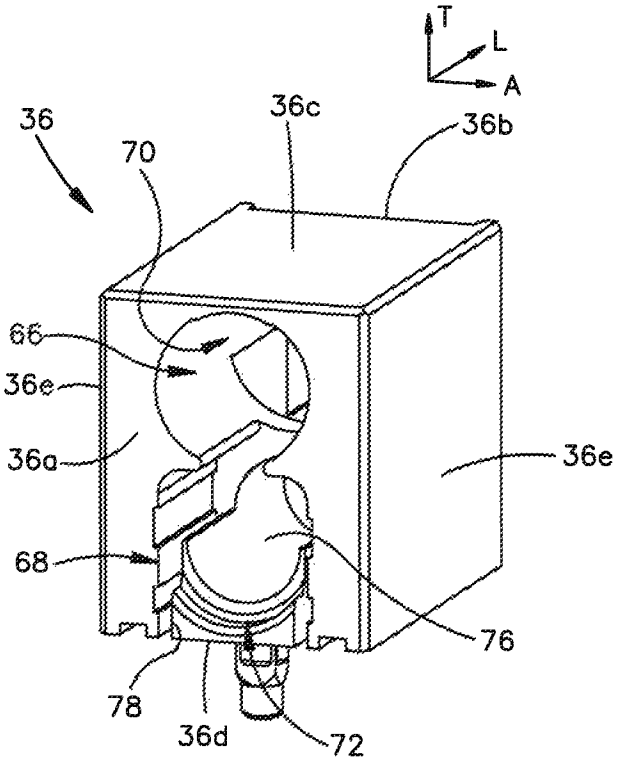
FIG. 2A is a perspective view of a connector housing of the electrical cable connector illustrated in FIG. 1A.
Figure 3C:
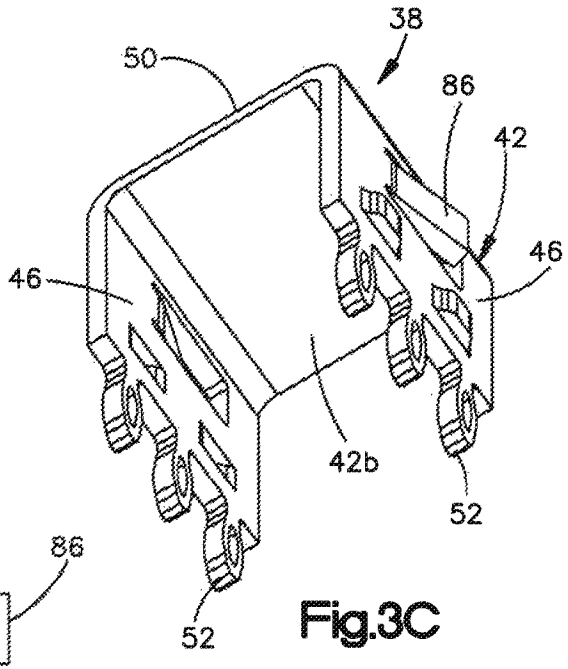
FIG. 3C is another perspective view of the first electrical terminal illustrated in FIG. 3A.
Figure 3B:
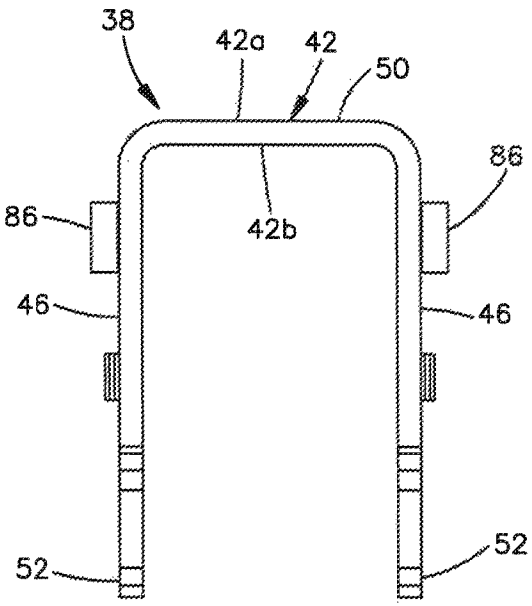
FIG. 3B is an end elevation view of the first electrical terminal illustrated in FIG. 3A.
Figure 3A:
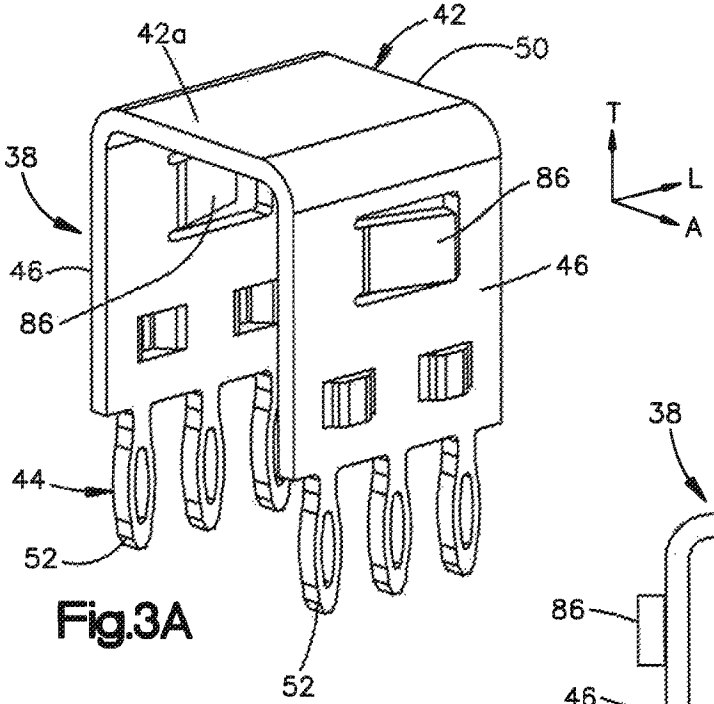
FIG. 3A is a perspective view of the first electrical terminal of the electrical cable connector illustrated in FIG. 1A.
Figure 3F:
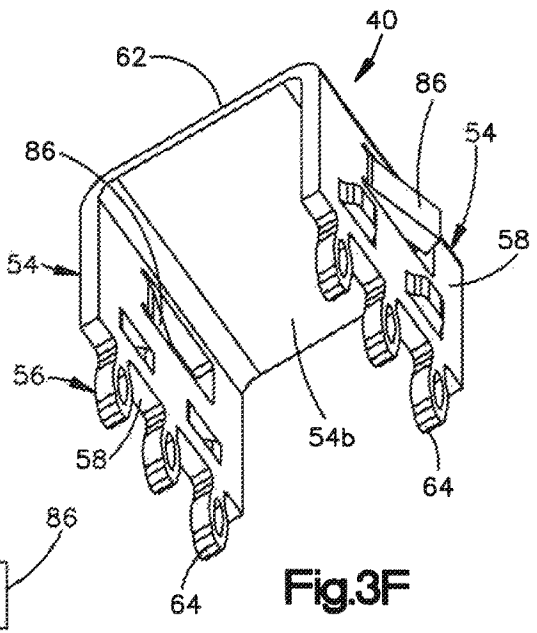
FIG. 3F is another perspective view of the second electrical terminal illustrated in FIG. 3D.
Figure 3E:
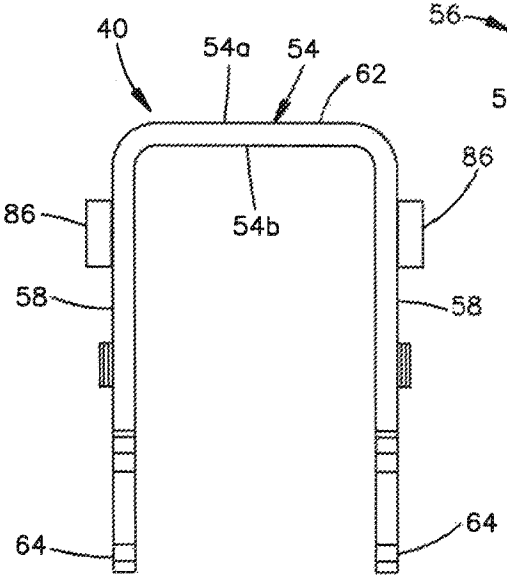
FIG. 3E is an end elevation view of the second electrical terminal illustrated in FIG. 3D.
Figure 3D:
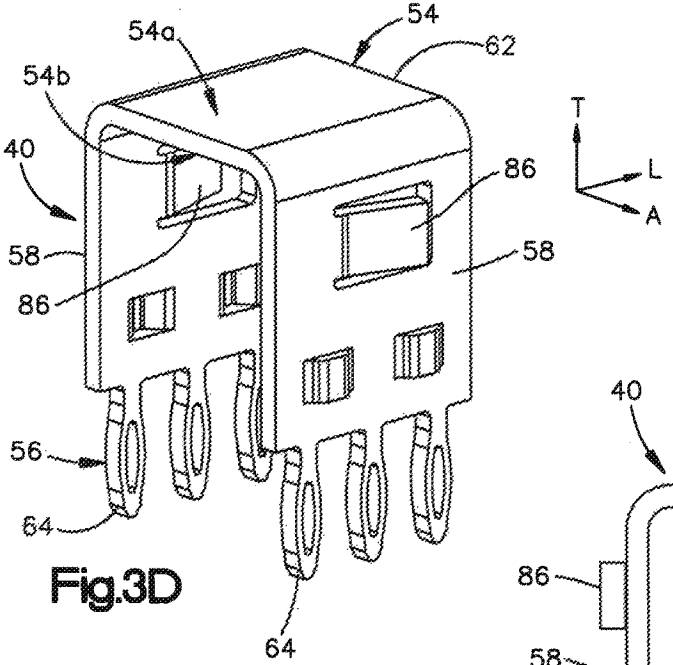
FIG. 3D is a perspective view of the second electrical terminal of the electrical cable connector illustrated in FIG. 1A.
Figure 4A:
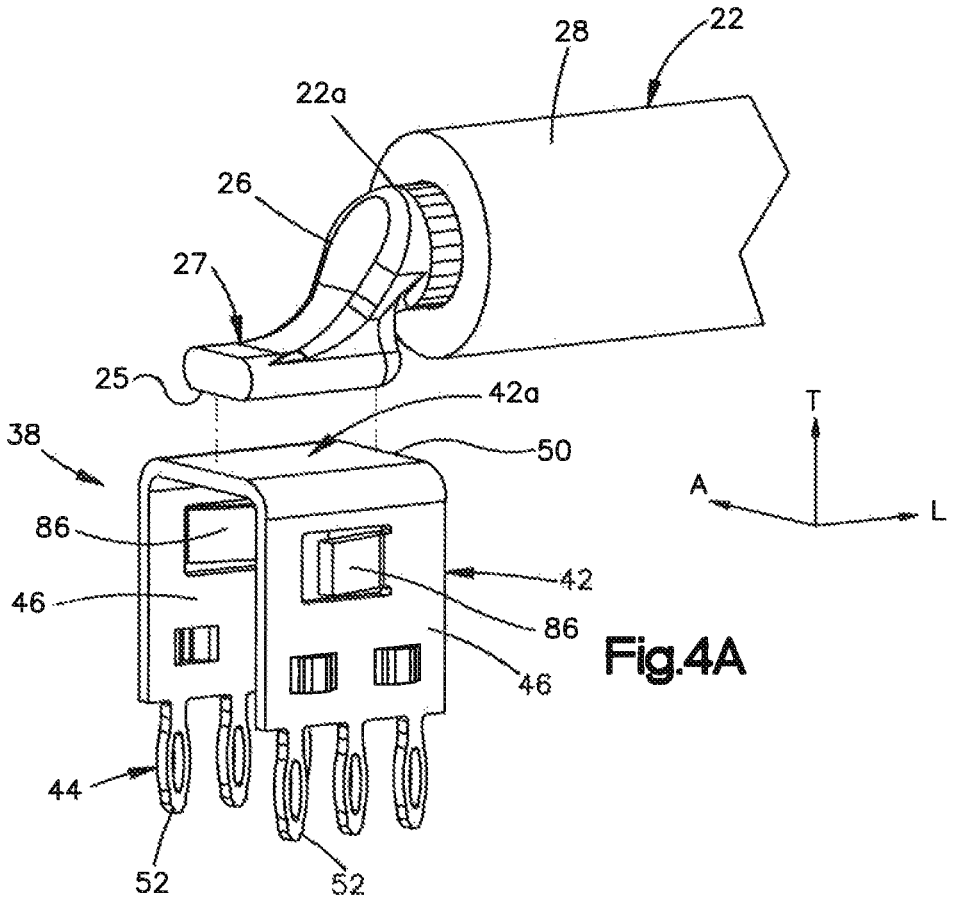
FIG. 4A is an assembly view showing attachment of the first electrical cable to the first electrical terminal of the cable connector illustrated in FIG. 1A.
Figure 4B:
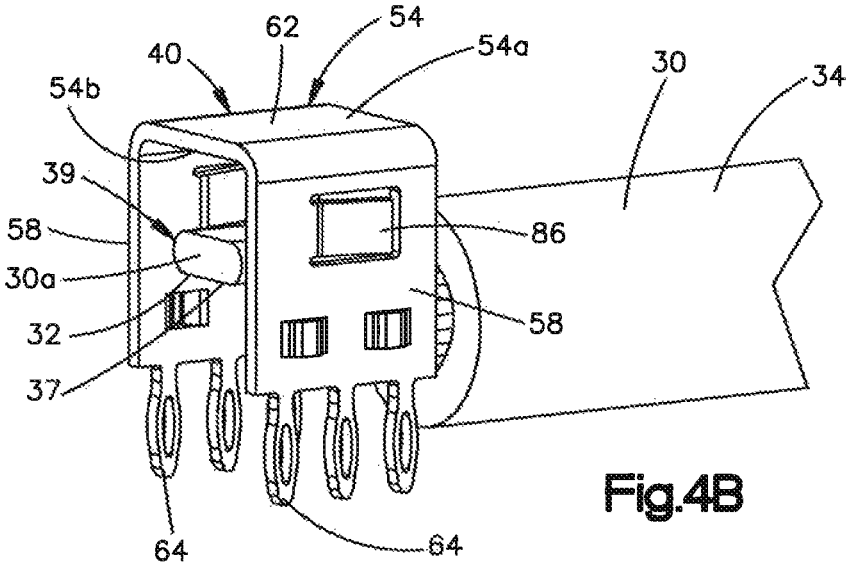
FIG. 4B is an assembly view showing attachment of the second electrical cable to the second electrical terminal of the cable connector illustrated in FIG. 1A.
Figure 4C:
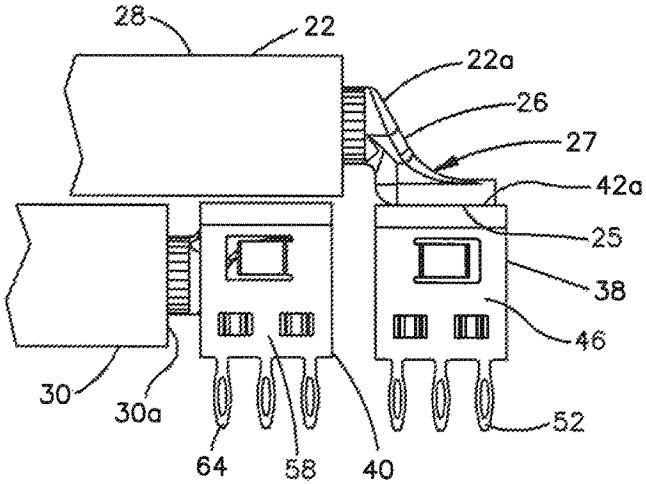
FIG. 4C is a side elevation view showing the first electrical cable attached to the first electrical terminal, and the second electrical cable attached to the second electrical terminal.
Figure 4E:
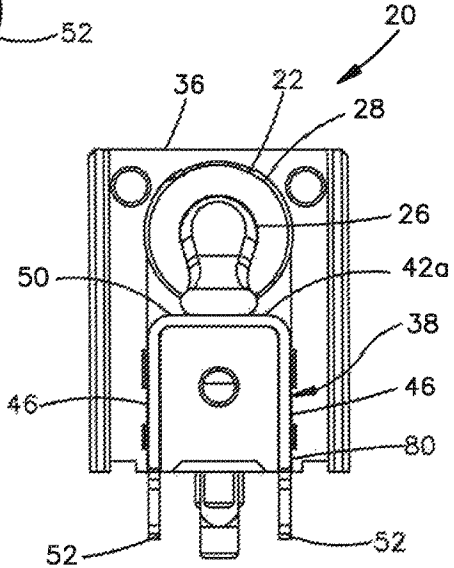
FIG. 4E is a rear end elevation view of the electrical cable connector illustrated in FIG. 1A.
Figure 4D:
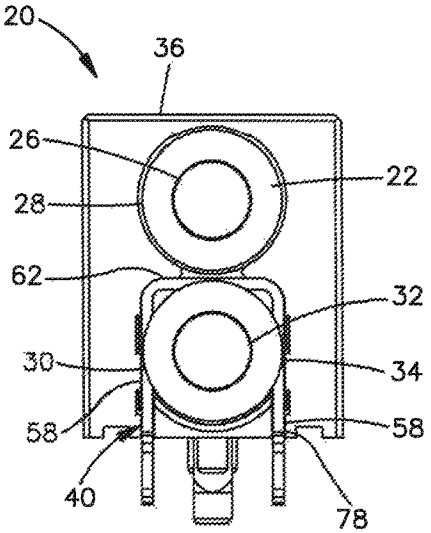
FIG. 4D is a front end elevation view of the electrical cable connector illustrated in FIG. 1A.
Figure 4F:
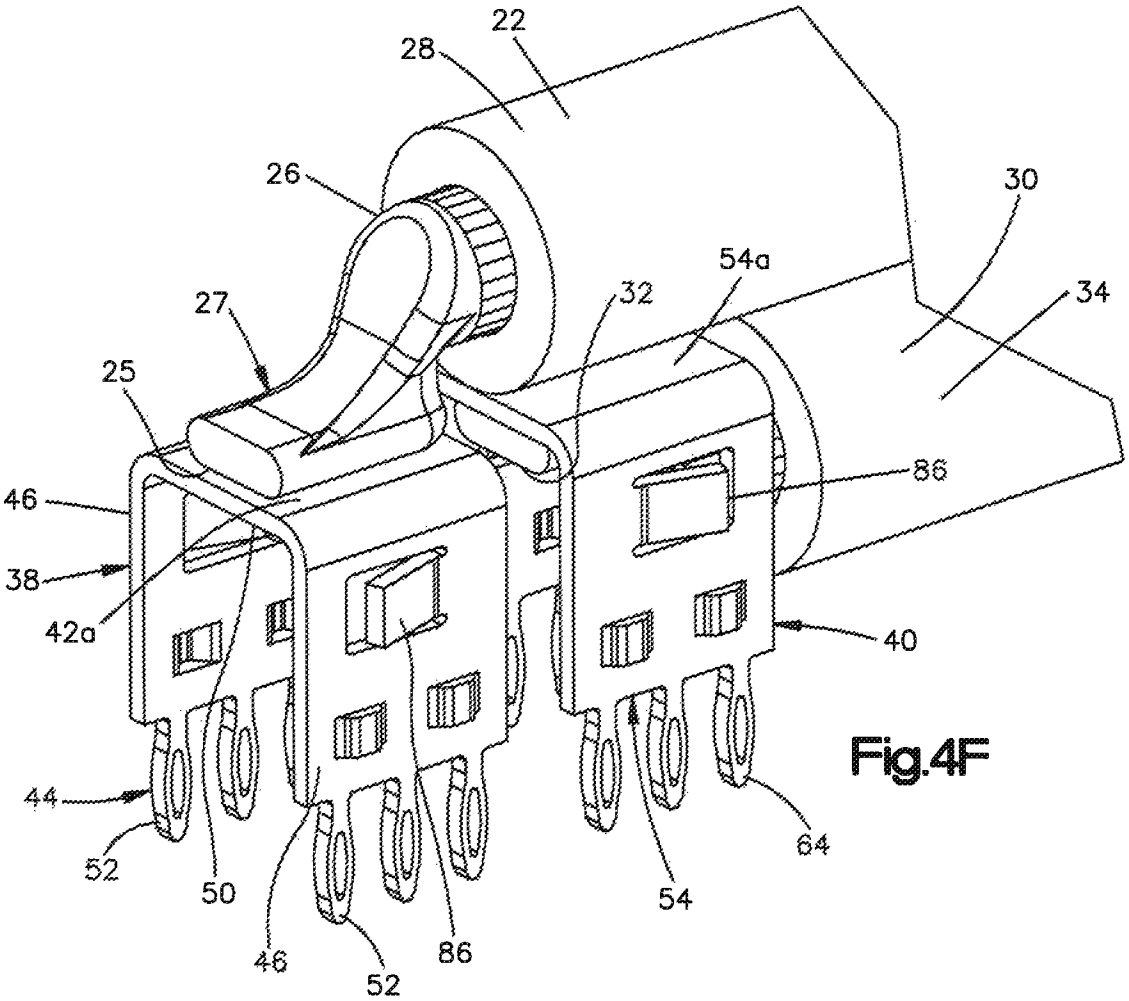
FIG. 4F is an enlarged perspective view of the first electrical cable attached to the first electrical terminal, and the second electrical cable attached to the second electrical terminal.
Figure 5:
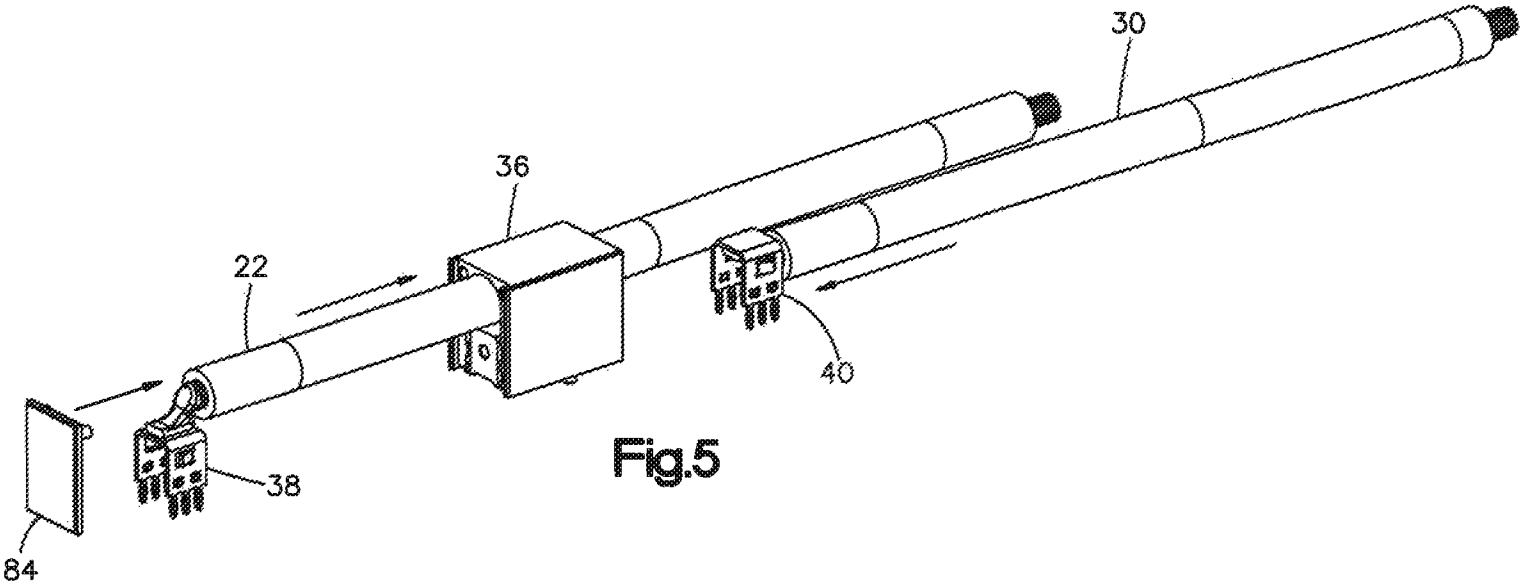
FIG. 5 is an assembly view showing insertion of the first electrical terminal and the first electrical cable into the connector housing, and insertion of the second electrical terminal and the second electrical cable into the connector housing.

Referring to FIGS. 1A-5, an electrical cable connector 20 can include a first electrical cable 22 that defines a first end 22*a* and a second end opposite the first end. The first electrical cable 22 can include a first electrical conductor 26 and a first electrical insulator 28 that surrounds at least a portion of the electrical conductor 26. The cable connector 20 can further include a second electrical cable 30 that defines a first end 30*a* and a second end opposite the first end. The second electrical cable 30 can include a second electrical conductor 32 and a second electrical insulator 34 that surrounds at least a portion of the second electrical conductor 32. The second electrical insulator 134 can be separate and free from the first electrical insulator 128. In certain embodiments, it is envisioned that one or both of the first and second electrical cables 22 and 30 can include a respective electrical conductor without an electrical insulator that surrounds the electrical conductor, for instance, when the electrical cables 22 and 30 are configured as ground conductors. The second electrical conductors 26 and 32 at the respective second ends of the first and second electrical cables 22 and 30, respectively, can be placed in electrical communication with a complementary electrical component, which can be a power source or a device configured to receive electrical power. In this regard, it should be appreciated that the first and second electrical cables 22 and 30 can be configured as electrical power cables. Alternatively, one of the first and second electrical cables 22 and 30 can be configured as a power cable, and the other of the first and second electrical cables 22 and 30 can be configured as a ground. For instance, the first electrical cable 22 can be configured as a power cable, and the second electrical cable 30 can be configured as a ground. The first and second electrical conductors 26 and 32 can include a plurality of stranded electrically conductive fibers of wire can be braided, twisted, or otherwise intertwined as desired.

The electrical cable connector 20 can further include a dielectric or electrically insulative connector housing 36, and first and second electrically conductive terminals 38 and 40 configured to be supported by the connector housing 36. The connector housing 36 can define a first end 36*a*, and a second end 36*b* opposite the first end 36*a* and spaced from the first end 36*a* along a longitudinal direction L. The first end 36*a* can be referred to as a front end, and the second end 36*b* can be referred to as a rear end. Thus, a forward direction can be defined along the longitudinal direction L from the second end 36*b* toward t e first end 36*a*. A rearward direction can be defined along the longitudinal direction L from the first end 36*a* toward the second end 36*b*. The connector housing 36 can further define a top 36*c* and a bottom 36*d* opposite the top 36*c* and spaced from the top 36*c* along a transverse direction T that is substantially perpendicular to the longitudinal direction L. Thus, a downward direction can be defined along the transverse direction T from the top 36*c* toward the bottom 36*d*. An upward direction can be defined along the transverse direction T from the bottom 36*d* toward the top 36*c*. The connector housing 36 can further define opposed sides 36*e* that are spaced from each other along a lateral direction A that is substantially perpendicular to each of the longitudinal direction L and the transverse direction T. The first and second electrical cables 22 and 30 are configured to be physically and electrically connected to the first and second electrical terminals 38 and 40, respectively, such that when the first and second electrical terminals 38 and 40 are supported by the connector housing 36, each of the first and second electrical cables 22 and 30 can extend out the first end 36*a*. Thus, a first terminal assembly can include the first electrical terminal 38 and the first electrical cable 22 attached to the first electrical terminal 38. Similarly, a second terminal assembly can include the second electrical terminal 40 and the second electrical cable 30 attached to the second electrical terminal 40.

The first electrical terminal 38 can include a first terminal body 42 and a first at least one mounting portion 44 that extends out from the first terminal body 42 and out the connector housing 36 in a first direction. For instance, the first direction can be a downward direction that extends along the transverse direction T. The first terminal body 42 can define a first surface 42*a* and a second surface 42*b* opposite the first surface 42*a*, and spaced from the first surface 42*a* in the first direction. Thus, the first surface 42*a* is spaced from the second surface 42*b* in a second direction opposite the first direction. The second direction can thus be an upward direction that extends along the transverse direction T. The first terminal body 42 can include first and second opposed walls 46 that are spaced from each other in the lateral direction A. The first terminal body 42 can further include a bridge member 50 connected between the first and second walls 46. The bridge member 50 can define the first surface 42*a* and the second surface 42*b*. For instance, the bridge member 50 can be a top wall connected between the top ends of the first and second walls 46. The first at least one mounting portion 44 can extend out of the connector housing 36 through the bottom 36*d*. The first at least one mounting portion 44 can include a plurality of first mounting terminals 52 that project down from the first terminal body 42. For instance, the mounting terminals 52 can project down from one or both of the first and second walls 46. The first mounting terminals 52 can be configured as press-fit tails, surface mounts, ball grid arrays, J-shaped leads, or any suitable alternatively constructed terminal configured to be placed in electrical communication with an underlying substrate, such as a printed circuit board. The first electrical terminal 38 can be stamped or otherwise formed as a single piece from a strip of suitable electrically conductive material as desired, such as a copper alloy. The first electrical terminal 38, for instance at the first surface 42*a*, can be plated with a lead-free tin over nickel.

The first and second electrical terminals 38 and 40 can be identical to each other. Accordingly, the second electrical terminal 40 can include a second terminal body 54 and a second at least one mounting portion 56 that extends out from the second terminal body 54 and out the connector housing 36 in the first direction. The second terminal body 54 can define a first surface 54*a* and a second surface 54*b* opposite the first surface 54*a*, and spaced from the first surface 54*a* in the first direction. Thus, the first surface 54*a* is spaced from the second surface 54*b* in the second direction. The second terminal body 54 can include first and second opposed walls 58 that are spaced from each other in the lateral direction A. The second terminal body 54 can further include a bridge member 62 connected between the first and second walls 58. The bridge member 62 can define the first surface 54*a* and the second surface 54*b*. For instance, the bridge member 62 can be a top wall connected between the top ends of the first and second walls 58. The bridge members 50 and 62 can be aligned with each other along the longitudinal direction L when they are supported in the connection housing such that the mounting portions 44 and 56 are coplanar with each other. The second at least one mounting portion 56 can extend out of the connector housing 36 through the bottom 36*d*. The second at least one mounting portion 56 can include a plurality of second mounting terminals 64 that project down from the second terminal body 54. For instance, the second mounting terminals can project down from one or both of the first and second walls 58. The second mounting terminals 64 can be configured as press-fit tails, surface mounts, ball grid arrays, j-shaped leads, or any suitable alternatively constructed terminal configured to be placed in electrical communication with an underlying substrate, such as a printed circuit board. Thus, the cable connector 20 can be referred to as a board mountable cable connector whose mounting portions 44 and 56 are configured to be mounted to an underlying substrate such as a printed circuit board. The second mounting terminals 64 can be stamped or otherwise formed as a single piece from a strip of suitable electrically conductive material as desired. The second electrical terminal 40 can be stamped or otherwise formed as a single piece from a strip of suitable electrically conductive material as desired, such as a copper alloy. The second electrical terminal 40, for instance at e first surface 42*a*, can be plated with a lead-free tin over nickel.

The first surface 42*a* of the first electrical terminal 38 can face the top 36*c* of the connector housing 36, and the second surface 42*b* of the first electrical terminal 38 can face the bottom. Similarly, the first surface 54*a* of the second electrical conductor 32 can face the top 36*c* of the connector housing 36, and the second surface 54*b* can face the bottom 54*b*. The first surface 42*a* can be spaced from the top 36*c* a first distance, and the second surface 42*b* can be spaced from the bottom 36*d* a second distance that is greater than the first distance. Similarly, the first surface 54*a* can be spaced from the top 36*c* a first distance, and the second surface 54*b* can be spaced from the bottom 36*d* a second distance that is greater than the first distance. Thus, the first surface 42*a* can be spaced from the top 36*c* a first distance, and the second surface 54*b* can be spaced from the bottom 36*d* a second distance that is greater than the first distance.

The first electrical cable 22, and in particular the first end of the first electrical conductor 26, can be mounted to the first surface 42*a* of the first electrical terminal 38. Thus, the first electrical terminal 38, and in particular the first terminal body 42, is capable of being mounted to the first electrical conductor 26. The second electrical cable 30, and in particular the first end of the second electrical conductor 32, can be mounted to the second surface 54*b* of the second electrical terminal 40. Thus, the second electrical terminal 40, and in particular the second terminal body 54, is capable of being mounted to the second electrical conductor 32. For instance, the first electrical conductor 26 can be ultrasonically welded to the first electrical terminal 38. Alternatively, the first electrical conductor 26 can be soldered to the first electrical terminal 38. Similarly, second electrical conductor 32 can be ultrasonically welded to the second electrical terminal 40. Alternatively, the second electrical conductor 32 can be soldered to the second electrical terminal 40.

In one example, the fibers of wire of the first electrical conductor 26 at the first end 22*a* of the first electrical cable 22 can be exposed from the insulator, and shaped so as to define at least one keyed surface 25, and fused to each other while shaped so as to define a solidified shape 27 having the at least one keyed surface 25, prior to electrically connecting the first end 22*a* to the first surface 42*a* of the first electrical terminal 38. Thus, the keyed surface 25 can correspond in shape to the first surface 42*a*. For instance, both the keyed surface 25 and the first surface can be substantially flat surfaces. In one example, the fibers of wire of the first electrical conductor 26 can be ultrasonically bonded, welded, or soldered to each other at the first end 22*a* so as to fuse the fibers of wire to each other. Similarly, the fibers of wire of the second electrical conductor 32 at the first end 30*a* of the second electrical cable 30 can be exposed from the second electrical insulator 34, and shaped so as to define at least one keyed surface 37, and fused to each other while shaped so as to define a solidified shape 39 having the at least one keyed surface 37, prior to electrically connecting the first end 30*a* to the second surface 54*b* of the second electrical terminal 40. Thus, the keyed surface 37 can correspond in shape to the second surface 54*b*. For instance, both the keyed surface 37 and the second surface 54*b* can be substantially flat surfaces. In one example, the fibers of wire of the first electrical conductor 26 can be ultrasonically bonded, welded, or soldered to each other at the first end 30*a* so as to fuse the fibers of wire to each other. In one example, the fibers of the first and second electrical conductors 26 and 32, respectively, can be ultrasonically bonded, welded, or soldered to each other at the respective first ends so as to fuse the fibers of wire to each other and to define the solidified shape having the at least one keyed surface.

The first and second electrical terminals 38 and 40, can be arranged in the connector housing 36 such that the second electrical terminal 40 is disposed between the first end 36*a* and the first electrical terminal 38, and the first electrical terminal 38 is disposed between the second electrical terminal 40 and the second end 36*b*. Alternatively, the first and second electrical terminals 38 and 40, can be arranged in the connector housing 36 such that the first electrical terminal 38 is disposed between the first end 36*a* and the second electrical terminal 40, and the second electrical terminal 40 is disposed between the first electrical terminal 38 and the second end 36*b*. The first and second ends 36*a* and 36*b* of the connector housing 36 can be spaced from each other along a second direction, such as the longitudinal direction L. Respective majorities or entireties of the first and second electrical terminals 38 and 40 can be aligned with each other along the second direction when the first and second electrical terminals 38 and 40 are disposed in the connector housing 36. Further, when the first and second electrical terminals 38 and 40 are disposed in the connector housing 36 and the first and second electrical cables 22 and 30 are attached to the first and second terminals, respectively, the first electrical cable 22 can be spaced from the second electrical cable 30 in the first direction at a location between the first and second ends 36*a* and 36*b*. For instance, when the first and second electrical terminals 38 and 40 are disposed in the connector housing 36 and the first and second electrical cables 22 and 30 are attached to the first and second terminals, respectively, the first electrical cable 22 can be aligned with the second electrical cable 30 in the first direction at a location between the first and second ends 36*a* and 36*b*. Otherwise stated, the second electrical cable 30 can be aligned with the first electrical cable 22 in the second direction. Thus, the first electrical cable 22 can be an upper electrical cable, and the second electrical cable 30 can be a lower electrical cable. Of course, it should be appreciated that the first electrical cable 22 can be the lower electrical cable, and the second electrical cable 30 can be the upper electrical cable.

The first and second cables 22 and 30 can exit the connector housing 36 at respective first and second openings 66 and 68 in one of the first and second ends 36*a* and 36*b*, such as the first end 36*a*. The first opening 66 can extend through the first end 36*a* along a first central axis, the second opening 68 can extend through the first end 36*a* along a second central axis. The first central axis can be spaced from the second central axis along the transverse direction. For instance, the first central axis can be aligned with the second central axis in the first direction. Each of the first and second openings 66 and 68 can be disposed between the top 36*c* and bottom 36*d*, and can further be disposed between the first and second sides 36*e*.

The connector housing 36 can define a first channel 70 that extends through the connector housing 36 from the first end 36*a* to the second end 36*b*. For instance, the first channel 70 can define the first opening 66. Alternatively, the first channel 70 can define the second opening 68. The connector housing 36 can define a second channel 72 that extends into the connector housing 36 from the first end 36*a* toward the second end 36*b*. The second channel 72 can terminate between the first end 36*a* and the second end 36*b*. For instance, the second channel 72 can define the second opening 68 and can extend through the connector housing 36 from the second opening 68 toward the second end 36*b*. Alternatively, the second channel 72 can define the first opening 66. The connector housing 36 can further define a third channel 74 that is aligned with at least a portion of the second channel 72 along the longitudinal direction L. The third channel 74 can extend from the second end 36*b* toward the first end 36*a*. The third channel 74 can be open to the first channel 70. For instance, the third channel can be open to the first channel 70 along the transverse direction T. The connector housing 36 can include a divider wall 76 that is disposed between the second and third channels 72 and 74.

A portion of the first terminal assembly that includes the first electrical terminal 38 and the first electrical cable 22 can be disposed in the third channel 74, and the second terminal assembly that includes the second electrical terminal 40 and the second electrical cable 30 can be disposed in the second channel 72. A portion of the first terminal assembly can further be disposed in the first channel 70. For instance, the first electrical terminal 38 can be disposed in the third channel 74, and the first electrical cable 22 can extend from the first surface 42*a* of the first terminal body 42, through the first channel 70, and out the first opening 66. The second electrical terminal 40 can be disposed in the second channel 72, and the second electrical cable 30 can extend from the second surface 54*b* of the second terminal body 54, through the second channel 72, and out the second opening 68.

The second channel 72, and thus the connector housing 36, can define a first at least one slot 78 that extends through the bottom 36*d*. Accordingly, a portion of the second electrical terminal 40 can extend through the first at least one slot 78 in the first direction, such that the second at least one mounting portion 56 extends through the first at least one slot 78 and out from the bottom 36*d* in the first direction, For instance, the first at least one slot 78 can include a pair of slots 78 that are spaced from each other in the lateral direction. The walls 58 can be aligned with respective ones of the first slots 78. Accordingly, the walls 58, the mounting portions 56, or both, can extend through the slots 78 and out the connector housing.

The third channel 74, and thus the connector housing 36, can define a second at least one slot 80 that extends through the bottom 36*d*. Accordingly, a portion of the first terminal body 42 can extend through the second at least one slot 80 in the first direction, For instance, the first at least one mounting portion 44 can extend through the second at least one slot 80 and out from the bottom 36*d* in the first direction. The first and second at least one mounting portions 44 can be coplanar. with each other. For instance, the second at least one slot 80 can include a pair of slots 80 that are spaced from each other in the lateral direction A. The walls 58 can be aligned with respective ones of the slots 80. Accordingly, the walls, the mounting portions 44, or both, can extend through the slots 80 and out the connector housing 36.

The electrical cable connector 20 can further include an end wall 82 that is configured to cover at least the first channel 70 at the second end 36*b* of the connector housing 36. For instance, the end wall 82 is configured to be in a first position whereby the end wall 82 covers the first and third channels 70 and 74 at the second end 36*b* and a second position whereby the end wall 82 is out of alignment with the first and third channels 70 and 74 at the second end 36*b*. Accordingly, when end wall 82 is out of alignment with the first and third channels 70 and 74 at the second end 36*b*, the first electrical terminal 38 and the first electrical cable 22 can be inserted into the connector housing 36 through the second end 36*b* along a direction toward the first end 36*a*, as is described in more detail below. When the end wall 82 is in the first position, the end wall 82 interferes with the first electrical cable 22 and the first electrical terminal 38 so as to render the first terminal assembly touch proof and to further prevent the first terminal assembly from traveling out the second end 36*b* of the connector housing 36. In one example, the end wall 82 can be removable from the connector housing 36, such that the end wall is in the first position when the end wall 82 is attached to the connector housing 36, and in the second position when the end wall 82 is removed from the connector housing. Alternatively, the end wall can be attached to the housing 36, and movable with respect to the connector housing 36 between the first and second positions. For instance, the end wall 82 can be hingedly attached to the housing 36, slidably attached to the housing 36, or otherwise attached to the housing.

In accordance with the illustrated example, the end wall 82 and the connector housing 36 have complementary engagement members that are received in each other when the end wall 82 is attached to second end 36*b* of the connector housing 36. For instance, the connector housing 36 can include an attachment wall 84 at the second end 36*b*. The second slots 80 can extend through the attachment wall 84 such that the first electrical terminal 38 and the first electrical cable 22 can be inserted into the connector housing 36 through the second end 36*b* along a direction toward the first end 36*a*. Each of the first and second terminals 38 and 40 can include retention barbs 86 that flare laterally outward from one or both the walls so as to press-fit or otherwise interfere with the connector housing 36 when the terminals are inserted in the connector housing 36, thereby resisting or preventing back-out of the respective electrical terminals along a direction opposite the insertion direction of the electrical terminals into the connector housing 36. The direction of insertion, and the direction opposite the direction of insertion, can both be oriented along the longitudinal direction L. When the electrical connector 20 is mounted to the underlying substrate, the longitudinal direction L can be oriented parallel to the substrate. Thus, the insertion direction can be parallel to a mounting interface of the connector housing 91, as described in more detail below.

Figure 6A:
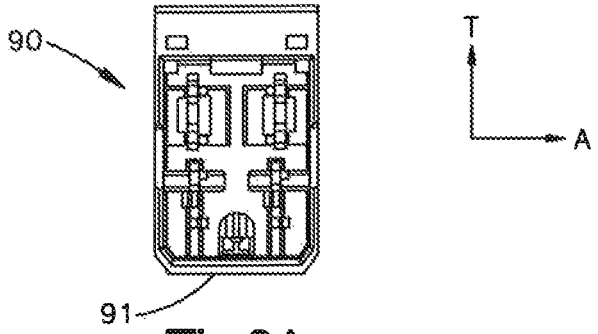
FIG. 6A is a front elevation view of a second electrical connector in accordance with one embodiment.
Figure 6B:
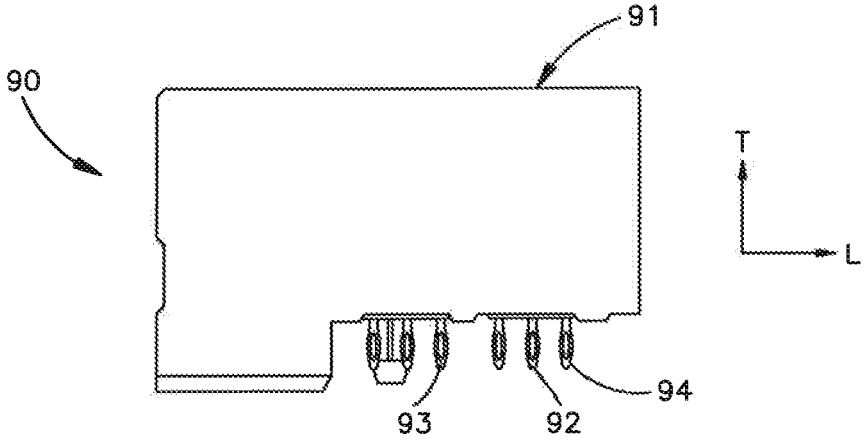
FIG. 6B is a side elevation view of the second electrical connector illustrated in FIG. 6A.
Figure 6C:
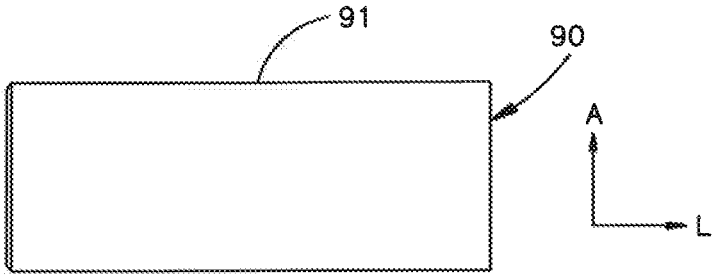
FIG. 6C is a top plan view of the second electrical connector illustrated in FIG. 6A.
Figure 7A:
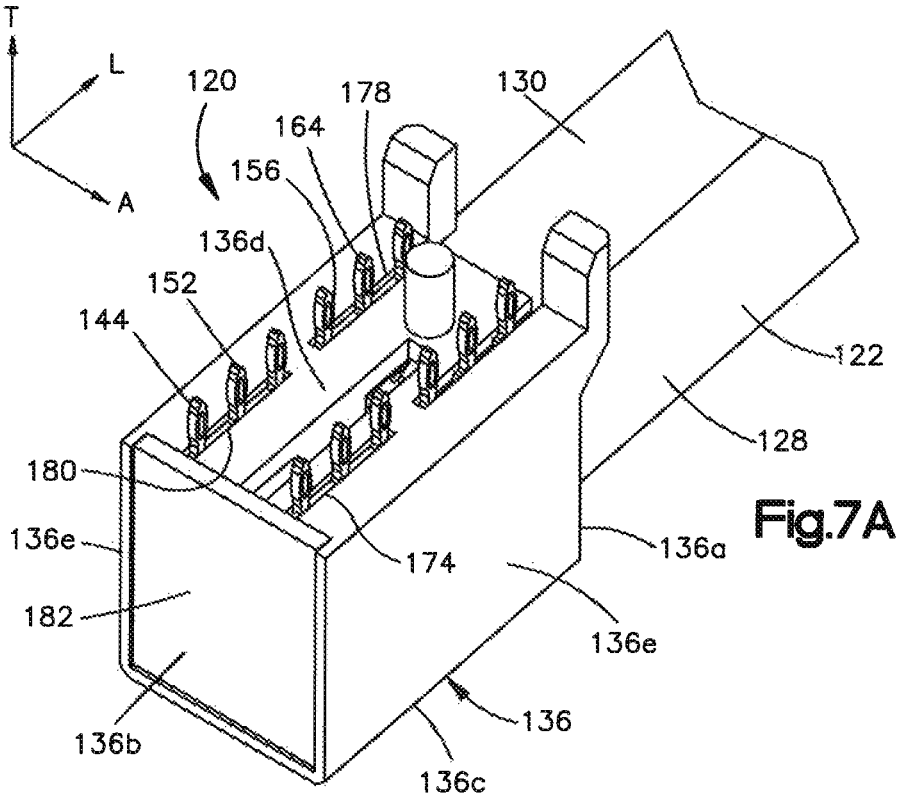
FIG. 7A is a perspective view of an electrical cable connector constructed in accordance with another embodiment including a connector housing, first and second electrical terminals, and first and second electrical cables.
Figure 7B:
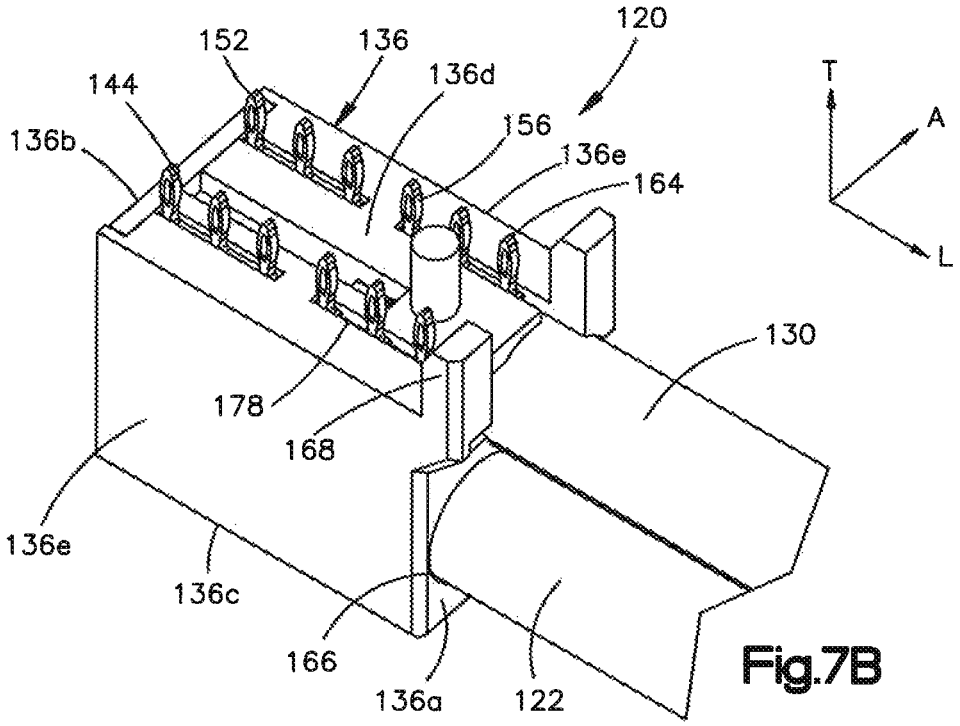
FIG. 7B is another perspective view of the electrical cable connector illustrated in FIG. 7A.
Figure 8A:
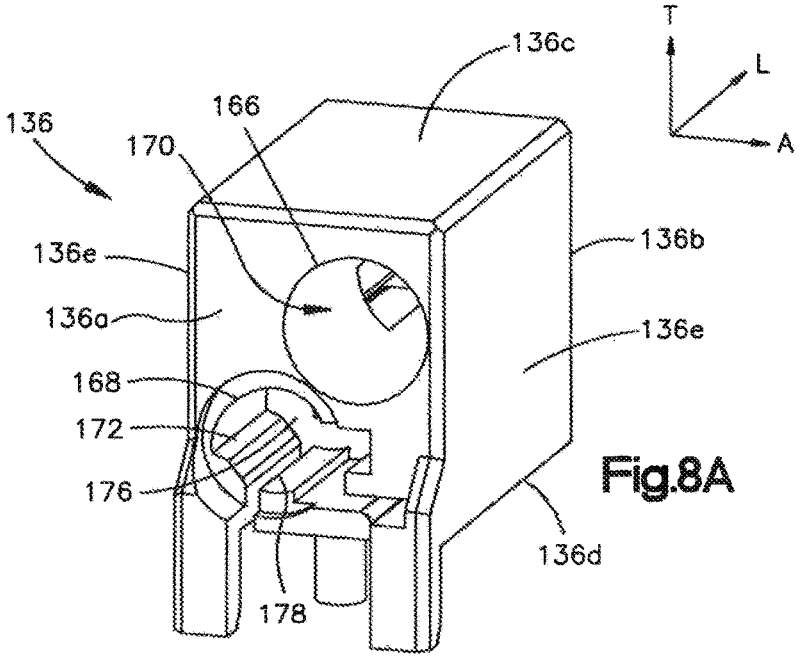
FIG. 8A is a perspective view of a connector housing of the electrical cable connector illustrated in FIG. 7A.
Figure 8B:
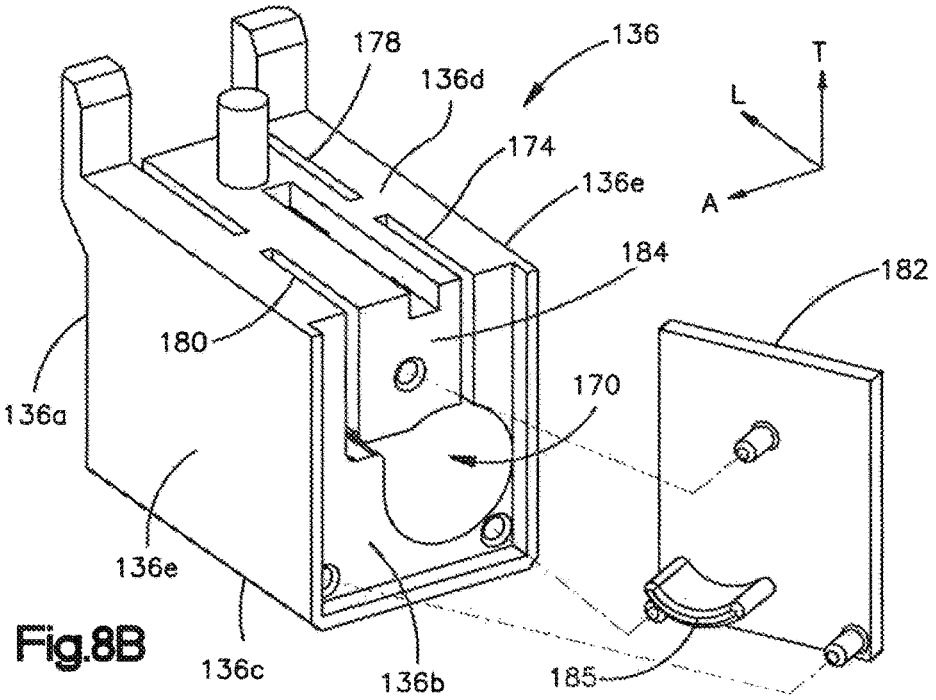
FIG. 8B is another perspective view of the connector housing illustrated in FIG. 8A.
Figure 9A:
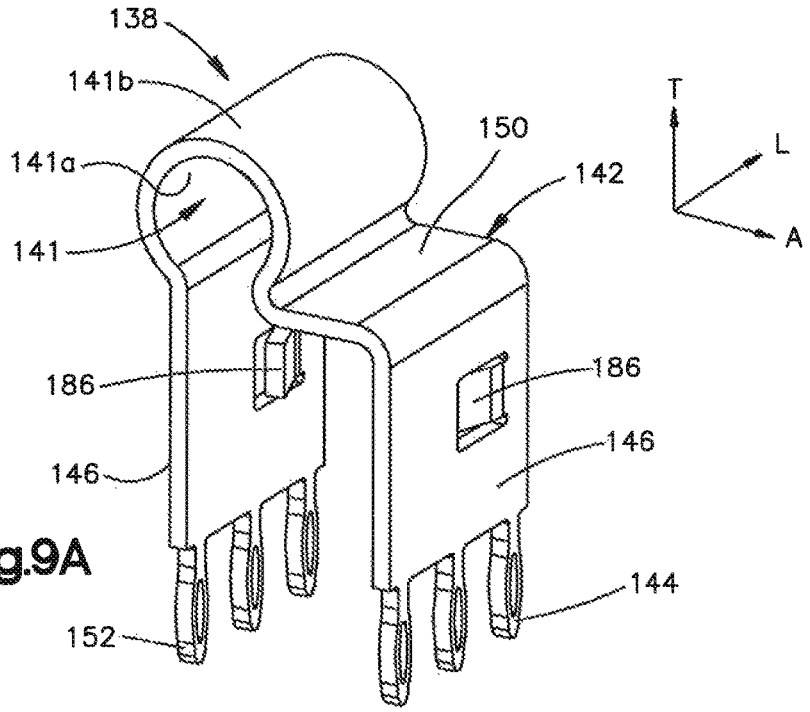
FIG. 9A is a perspective view of the first electrical terminal of the electrical cable connector illustrated in FIG. 7A.
Figure 9B:
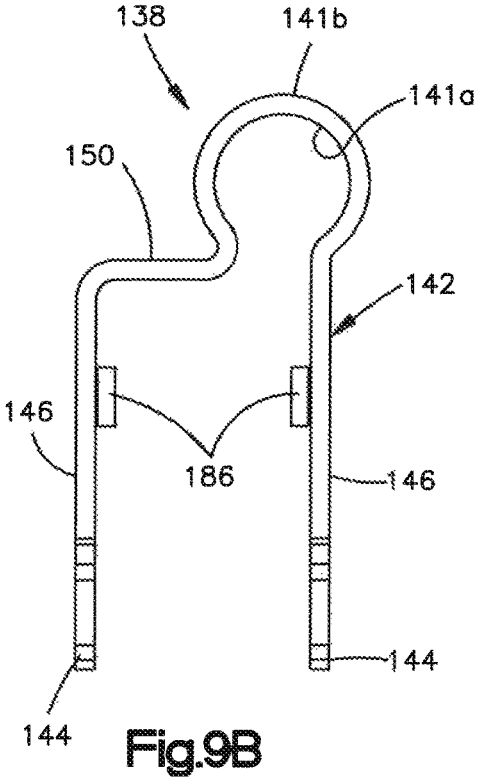
FIG. 9B is an end elevation view of the first electrical terminal illustrated in FIG. 9A.
Figure 9C:
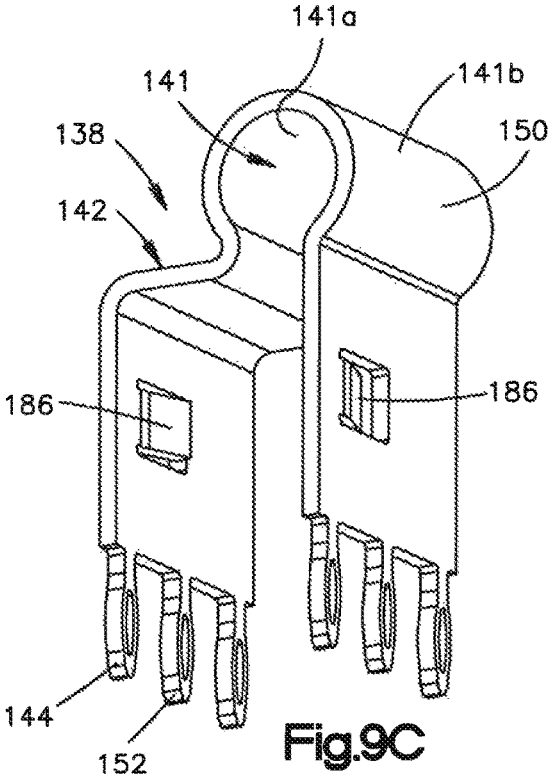
FIG. 9C is another perspective view of the first electrical terminal illustrated in FIG. 9A.
Figure 9D:
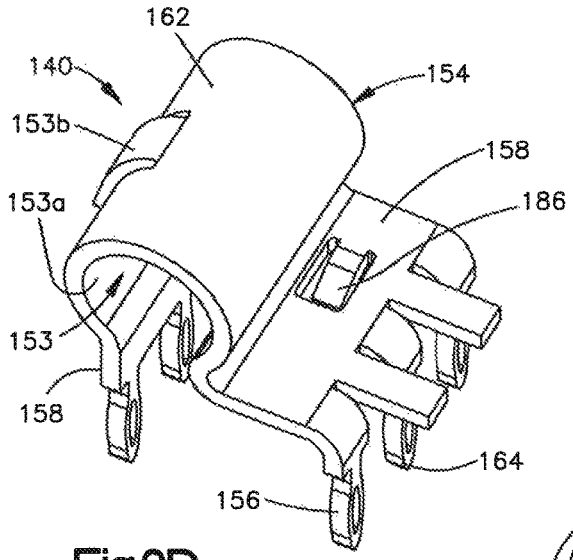
FIG. 9D is a perspective view of the second electrical terminal of the electrical cable connector illustrated in FIG. 7A.
Figure 9E:
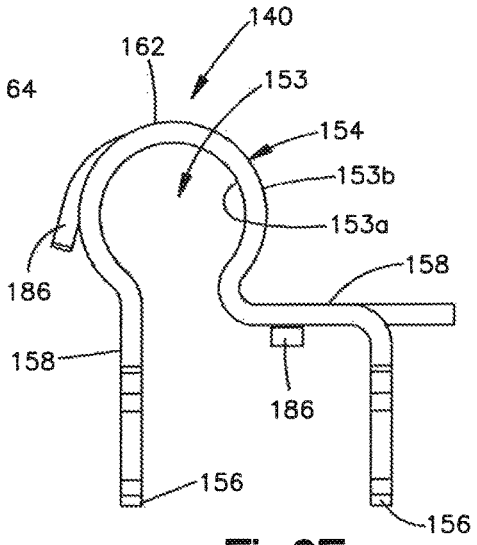
FIG. 9E is an end elevation vie of second electrical terminal illustrated in FIG. 9D.
Figure 9F:
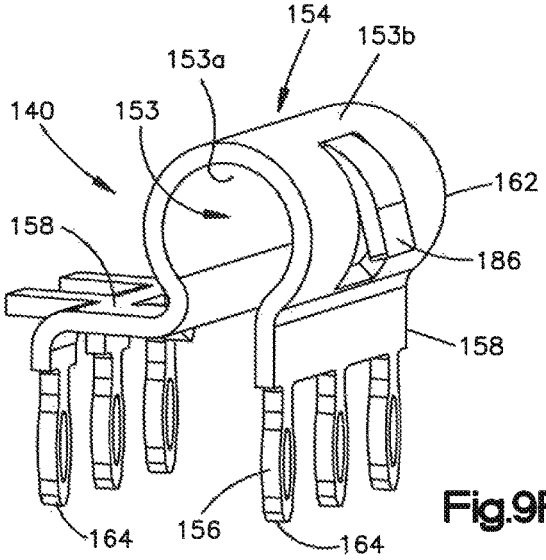
FIG. 9F is another perspective view of the second electrical terminal illustrated in FIG. 9D.
Figure 10A:
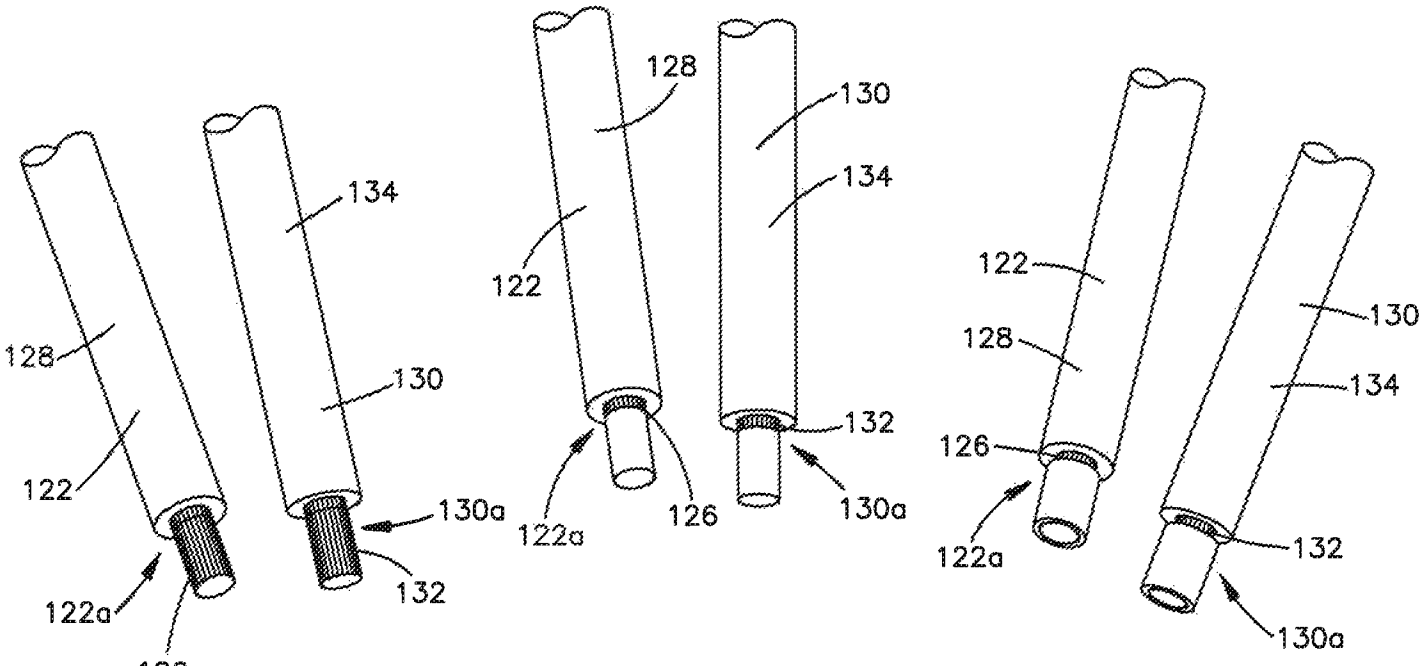
FIG. 10A shows perspective views associated with coating electrical conductors of the electrical cables with a tinning and a solder dip.
Figure 10B:
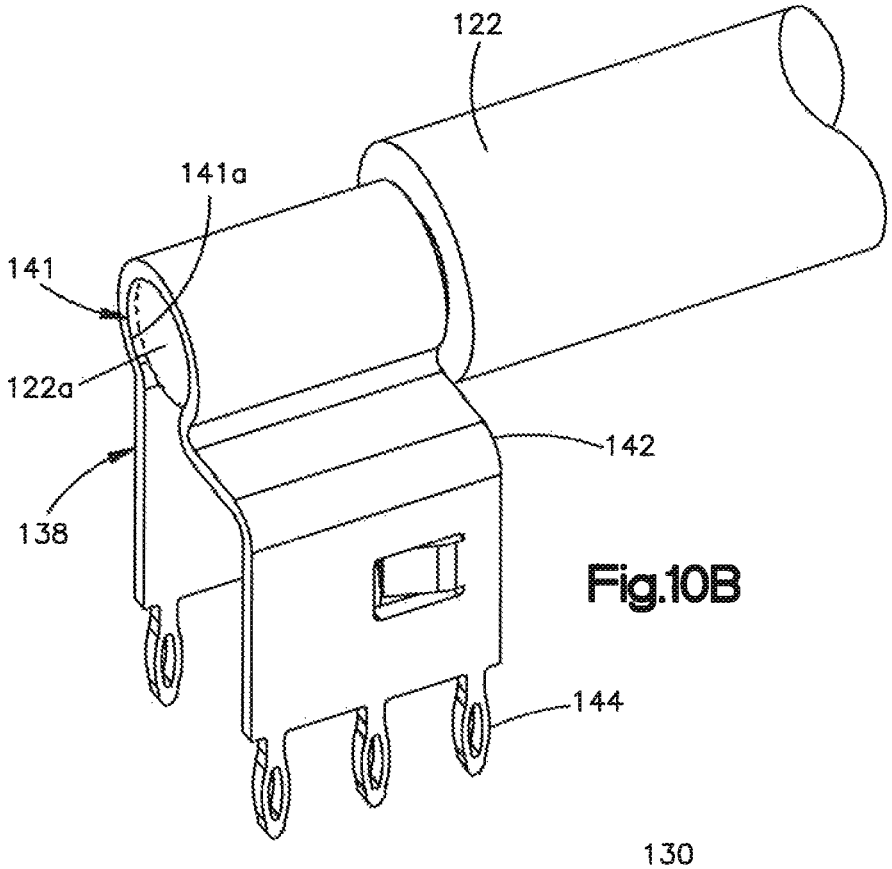
FIG. 10B is perspective view showing the first electrical cable attached to the firs electrical terminal of the cable connector illustrated in FIG. 7A.
Figure 10C:
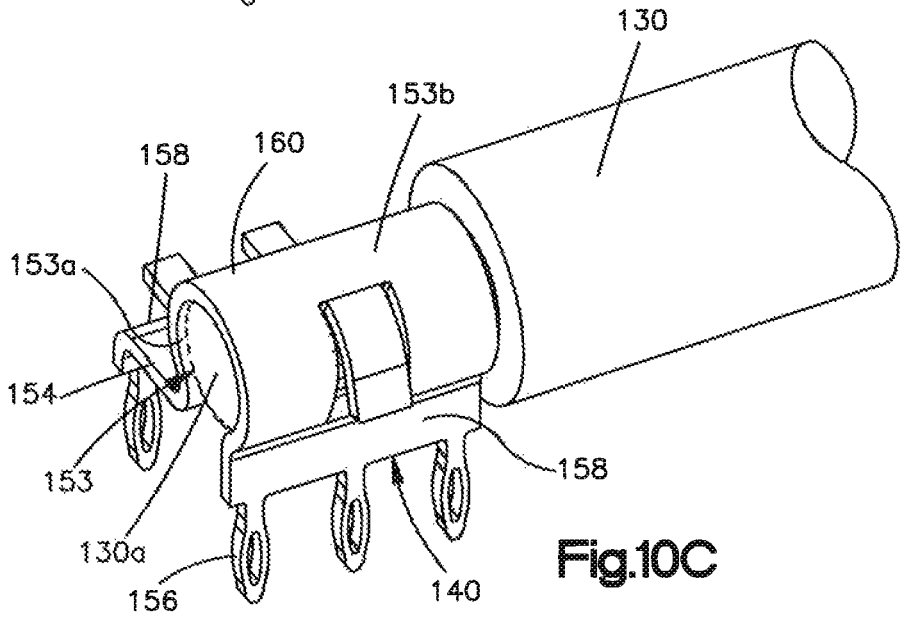
FIG. 10C is a perspective view showing the second electrical cable attached to the second electrical terminal of the cable connector illustrated in FIG. 7A.
Figure 11A:
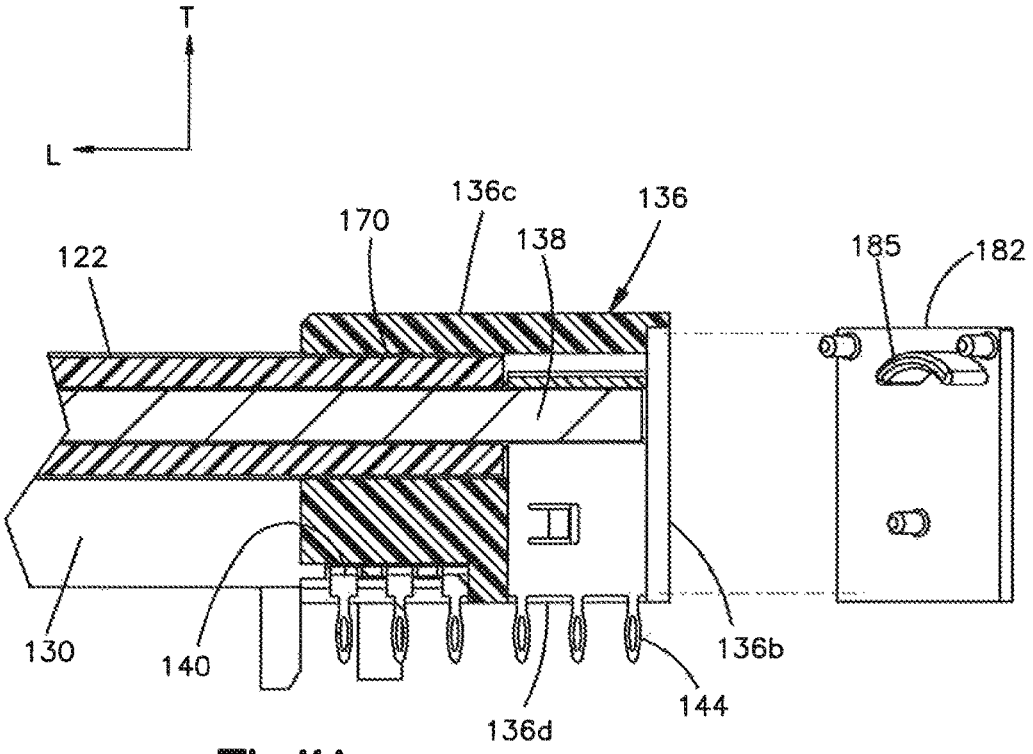
FIG. 11A is a sectional side elevation view of the cable connector illustrated in FIG. 7A.
Figure 11B:
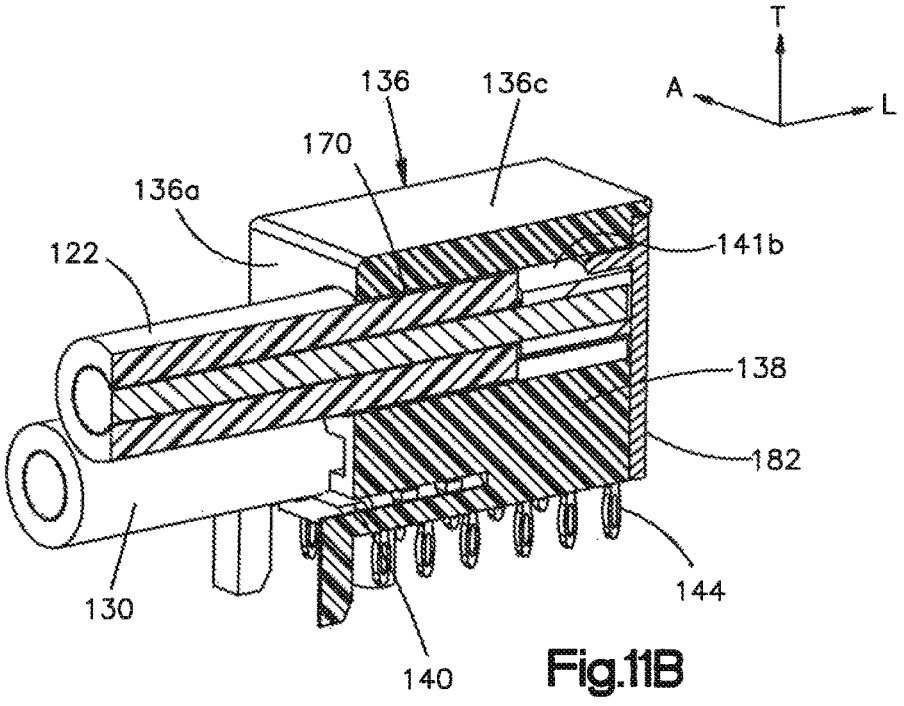
FIG. 11B is another sectional side elevation view of the cable connector illustrated in FIG. 7A.
Figure 11C:
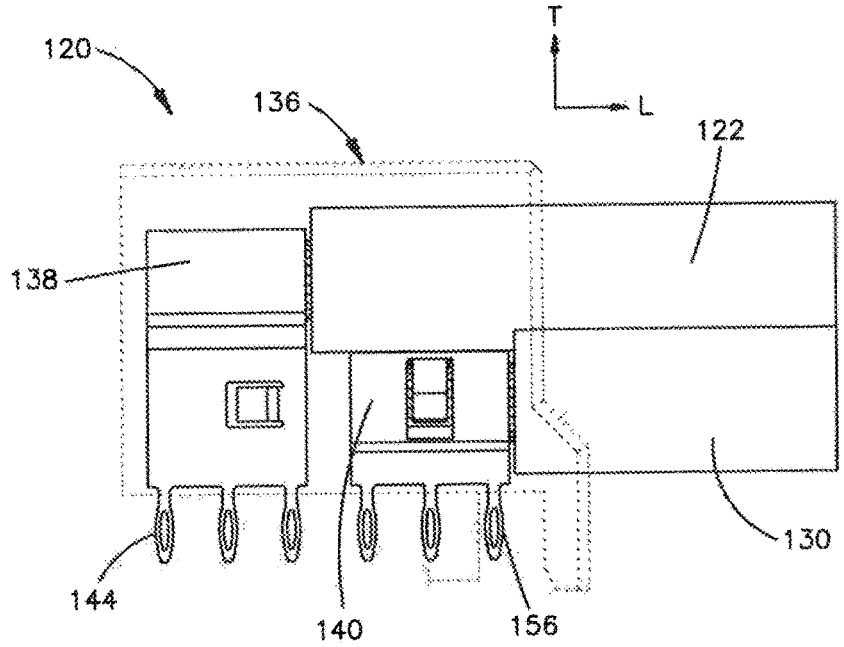
FIG. 11C is a side elevation view of the cable connector illustrated in FIG. 7A, showing the connector hosing as transparent for the purposes of visibility inside the connector housing.
Figure 11D:
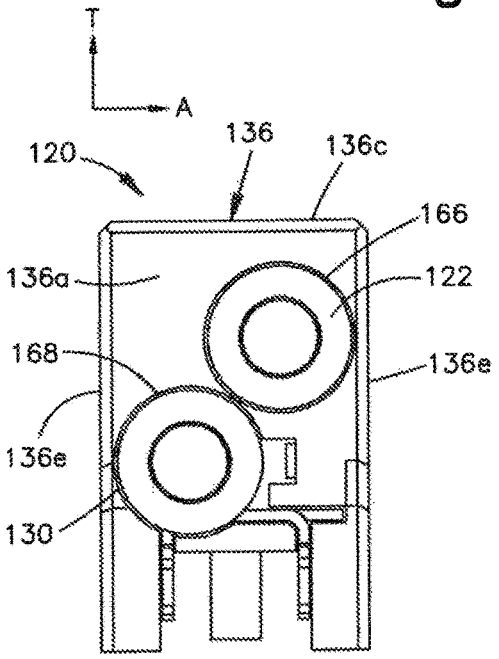
FIG. 11D is a front end elevation view of the electrical cable connector illustrated in FIG. 7A.
Figure 11E:
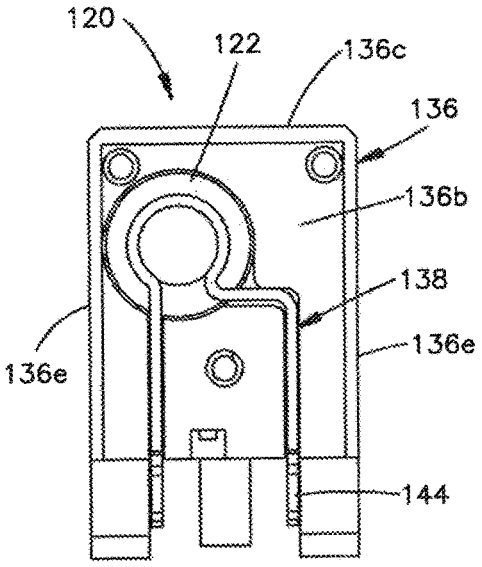
FIG. 11E is a rear end elevation view of the electrical cable connector illustrated in FIG. 7A.
Figure 11F:
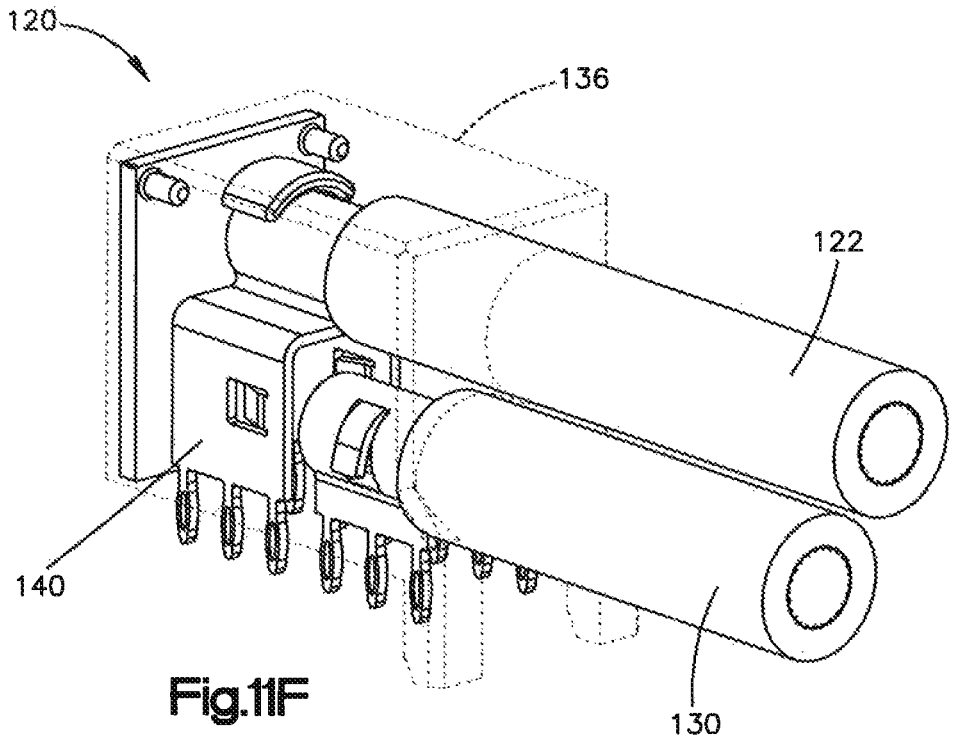
FIG. 11F is a perspective view of the electrical cable connector illustrated in FIG. 7A, showing the connector housing as transparent for the purposes of visibility inside the connector housing.
Figure 11G:
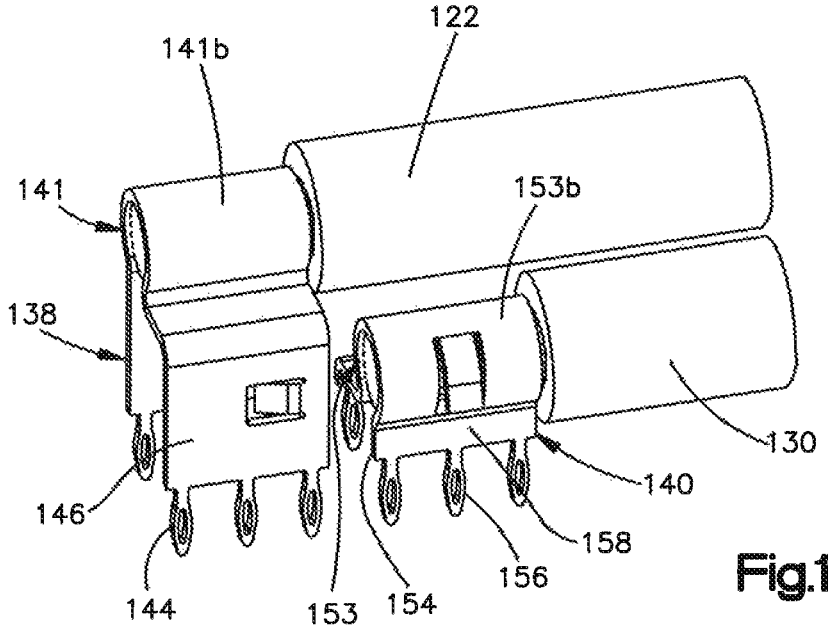
FIG. 11G is a perspective view of first and second terminal assemblies of the cable connector illustrated in FIG. 7A.
Figure 12A:
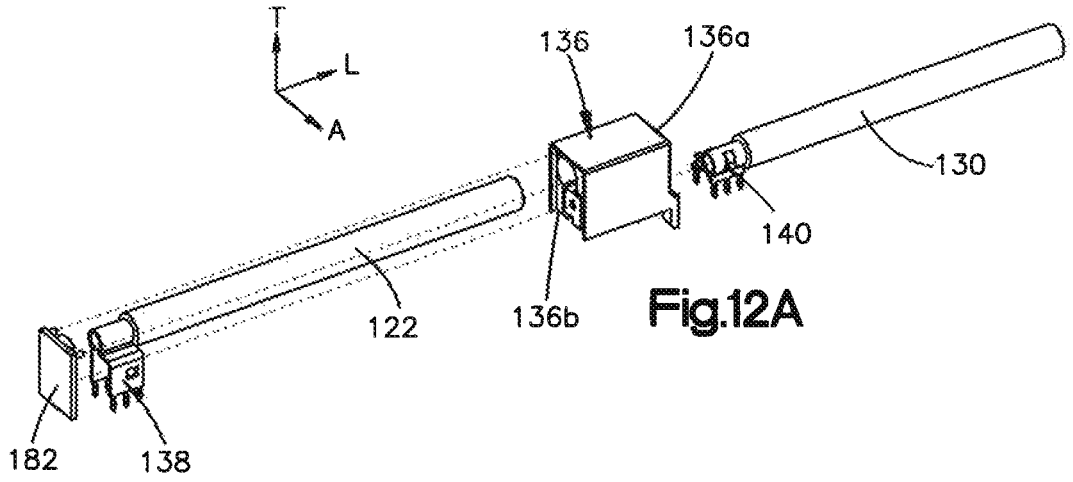
FIG. 12A is an assembly view of the cable connector illustrated in FIG. 7A, showing insertion of the first electrical terminal and the first electrical cable into the connector housing, and insertion of the second electrical terminal and the second electrical cable into the connector housing.
Figure 12B:
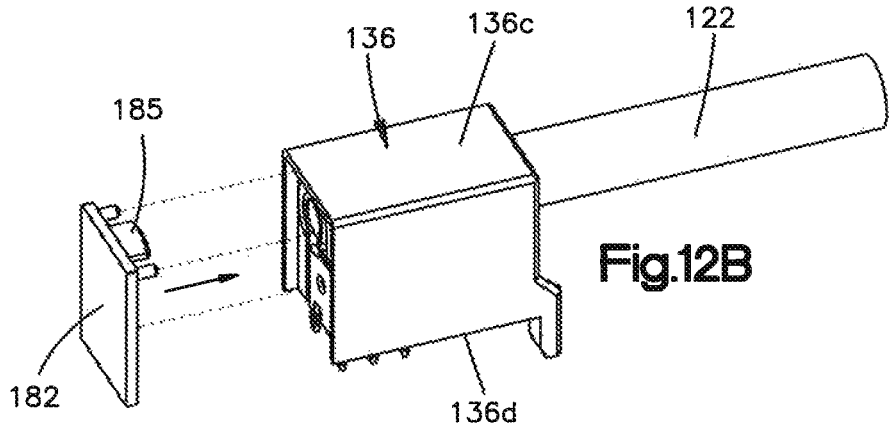
FIG. 12B is a further assembly view of the cable connector illustrated in FIG. 7A, showing attachment of an end wall to the rear end of the connector housing.
Figure 12C:
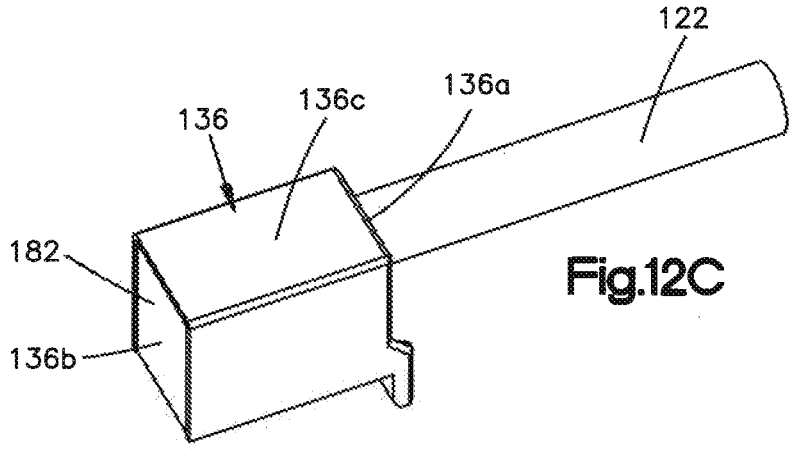
FIG. 12C is a perspective view of the cable connector illustrated in FIG. 7A.
Figure 13A:
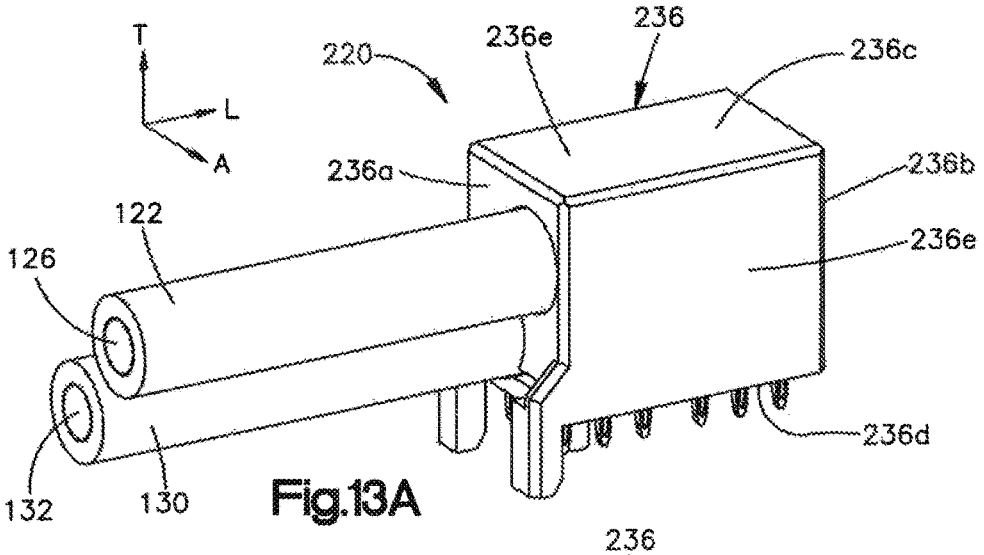
FIG. 13A is a perspective view of an electrical cable connector constructed in accordance with another embodiment including a connector housing, first and second electrical terminals, and first and second electrical cables.
Figure 13B:
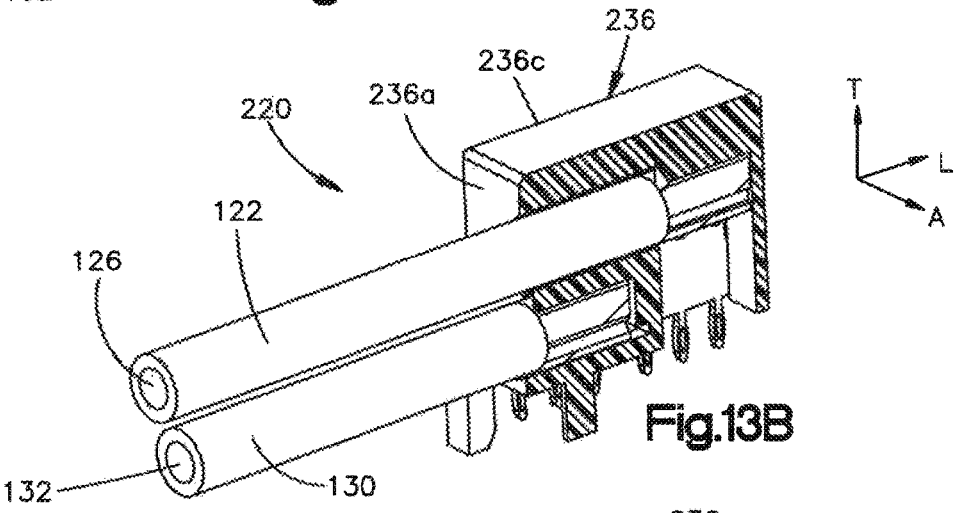
FIG. 13B is another perspective view of the electrical cable connector illustrated in FIG. 13A, showing the connector housing as transparent for the purposes of visibility into the connector housing.
Figure 13C:
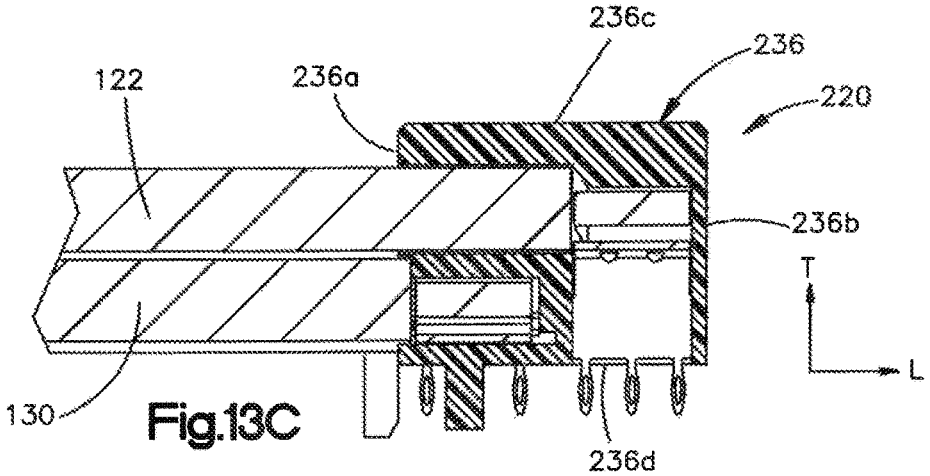
FIG. 13C is a side elevation view of the electrical cable connector illustrated in FIG. 13A, showing the connector housing as transparent for the purposes of visibility into the connector housing.
Figure 13D:
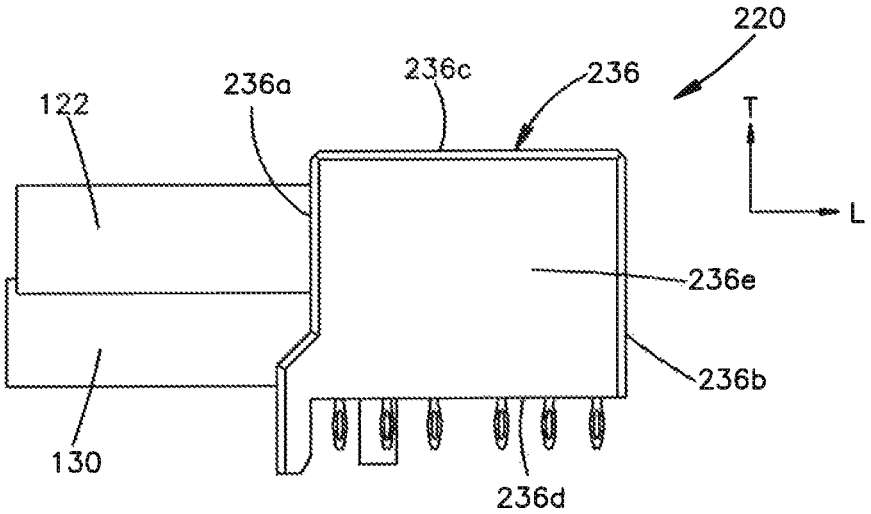
FIG. 13D is another side elevation view of the electrical cable connector illustrated in FIG. 13A.
Figure 14A:
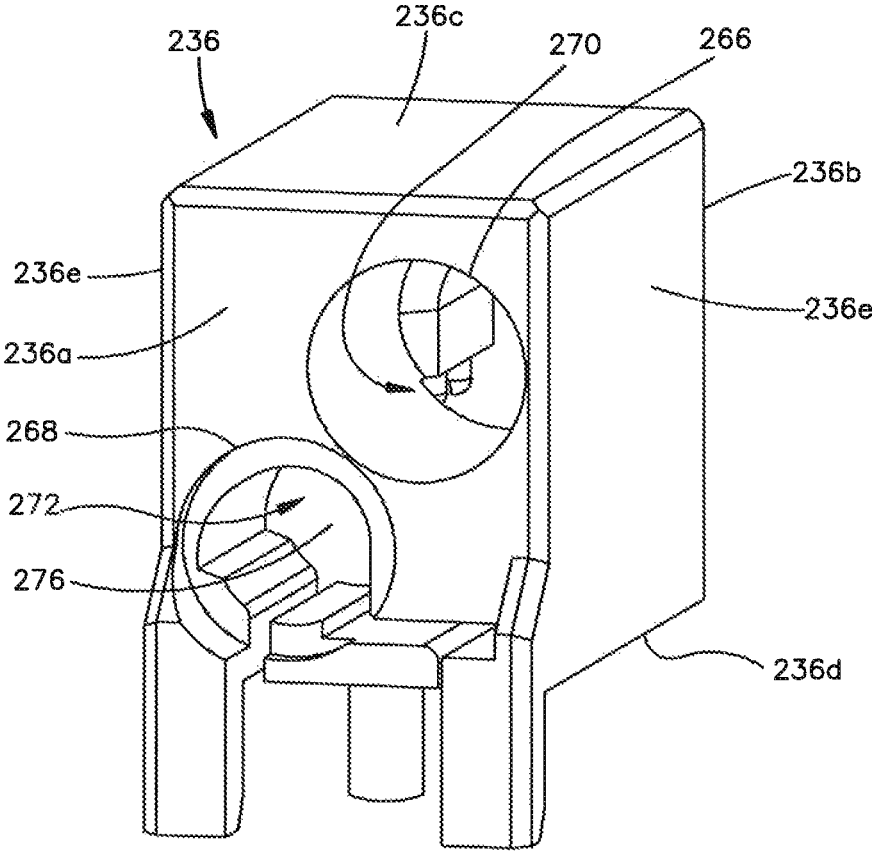
FIG. 14A is a perspective view of a connector housing of the electrical cable connector illustrated in FIG. 13A.
Figure 14B:
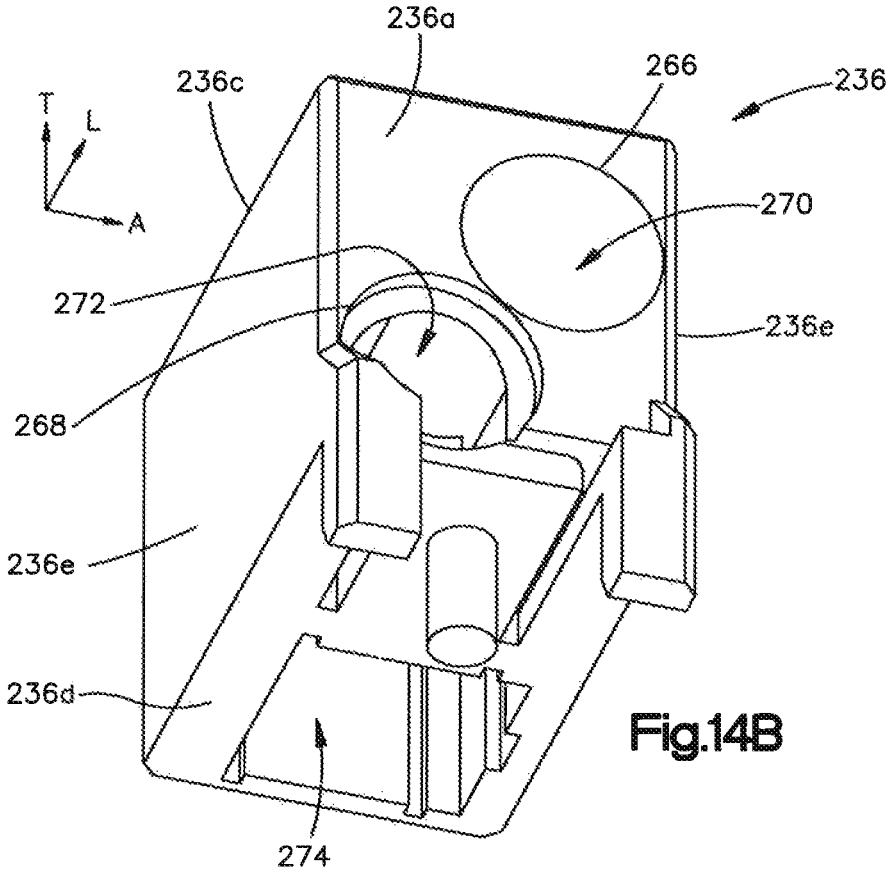
FIG. 14B is another perspective view of the connector housing illustrated in FIG. 14A.
Figure 14C:
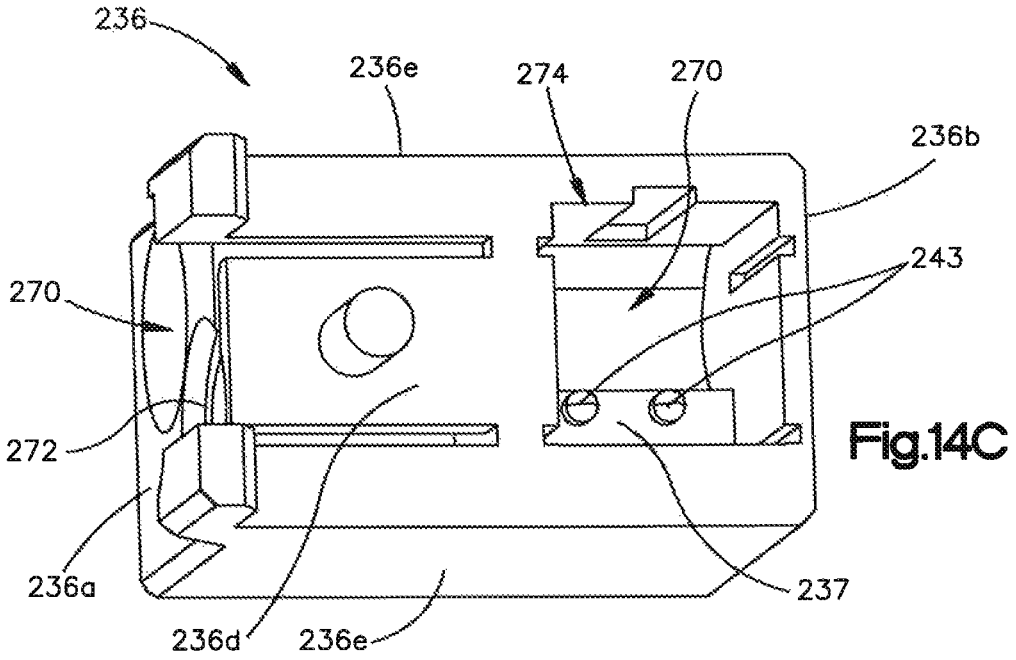
FIG. 14C is another perspective view of the connector housing illustrated in FIG. 14A.
Figure 15B:
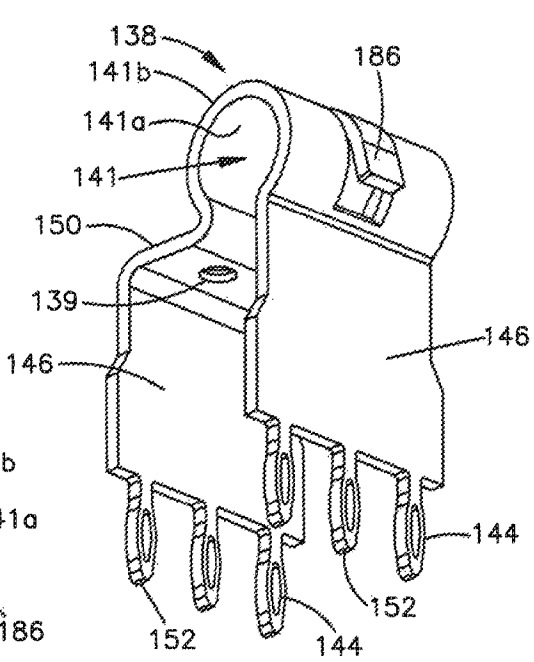
FIG. 15B is another perspective view of the first electrical terminal illustrated in FIG. 15A.
Figure 15C:
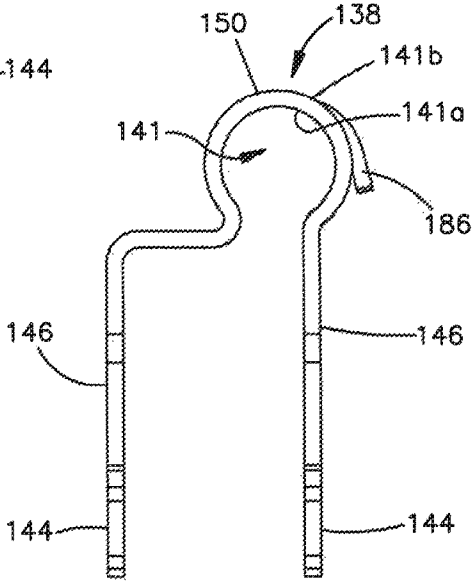
FIG. 15C is an end elevation view of the first electrical terminal illustrated in FIG. 15A.
Figure 15A:
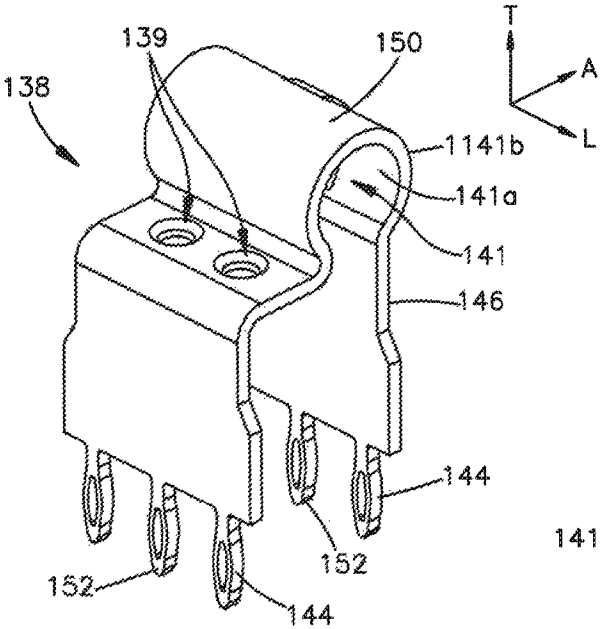
FIG. 15A is a perspective view of the first electrical terminal of the electrical cable connector illustrated in FIG. 13A.
Figure 15E:
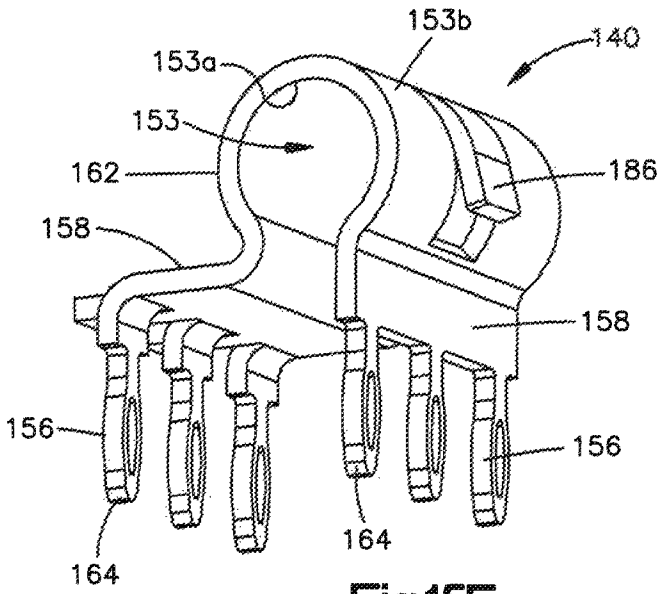
FIG. 15E is another perspective view of the second electrical terminal illustrated in FIG. 15D.
Figure 15F:
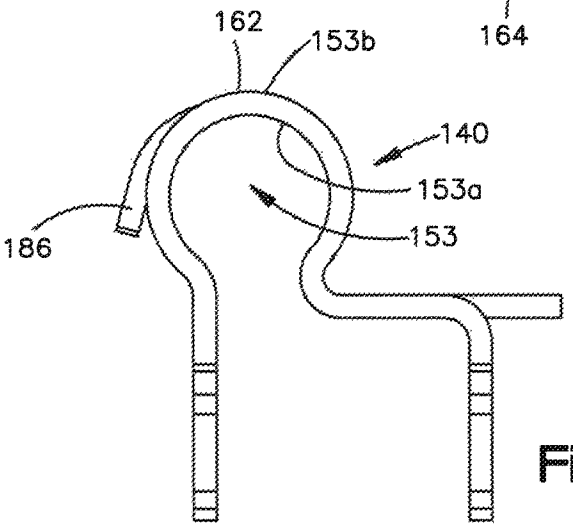
FIG. 15F is an end elevation view of the second electrical terminal illustrated in FIG. 15D.
Figure 15D:
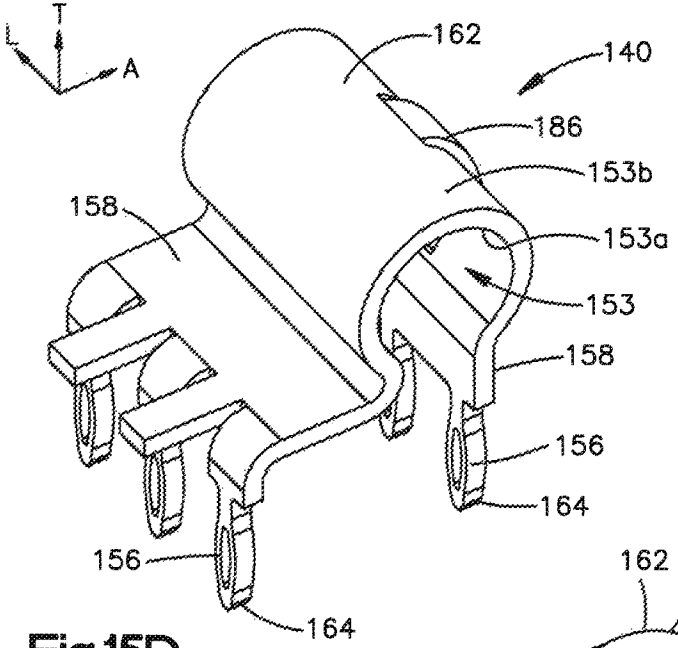
FIG. 15D is a perspective view of the second electrical terminal of the electrical cable connector illustrated in FIG. 15A.
Figure 16B:
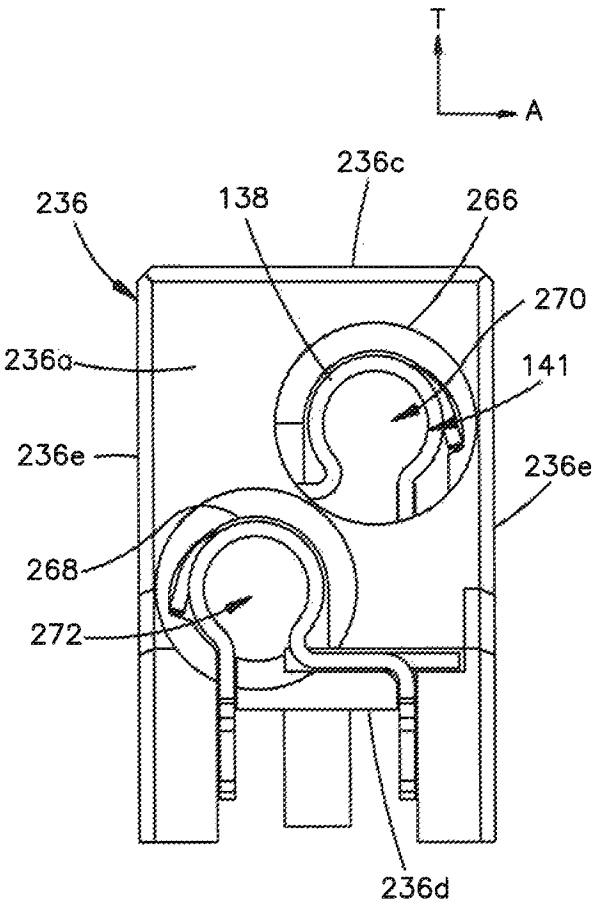
FIG. 16B is a rear end elevation view of the cable connector illustrated in FIG. 13A.
Figure 16A:
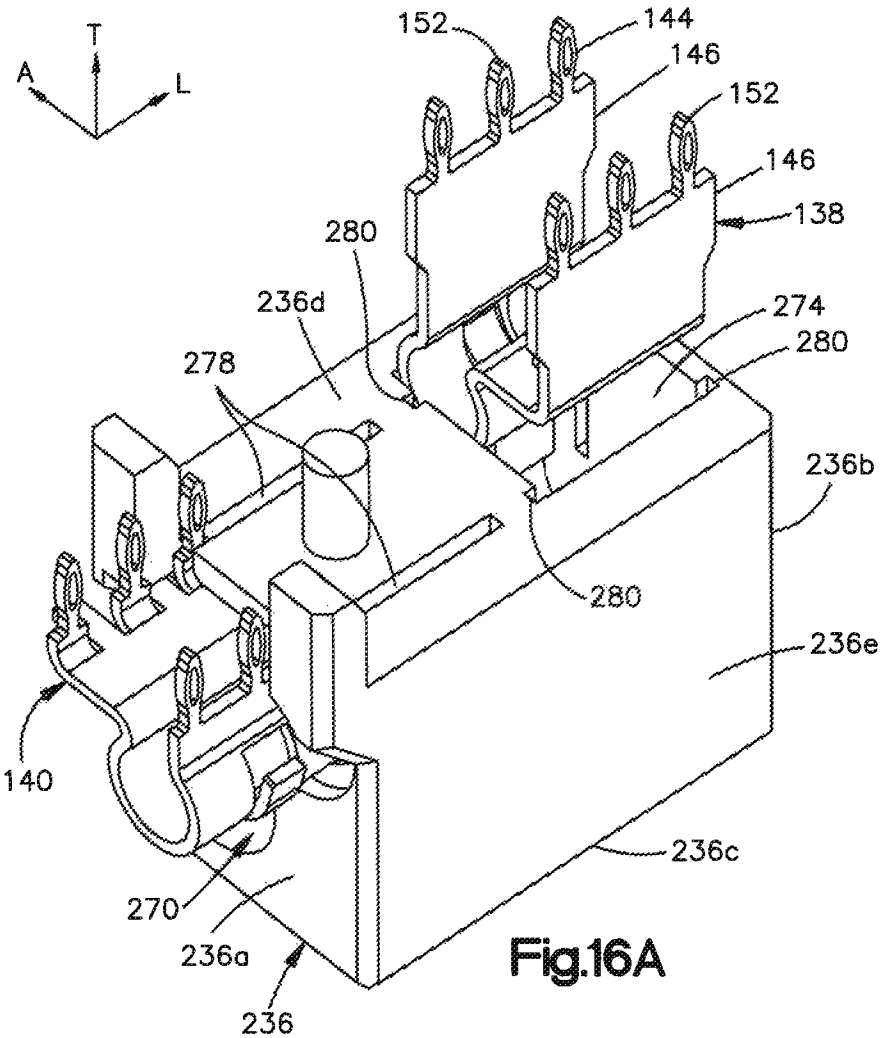
FIG. 16A is an assembly view of the cable connector illustrated in FIG. 13A, showing insertion of the first and second electrical terminals into the connector housing.
Figure 17A:
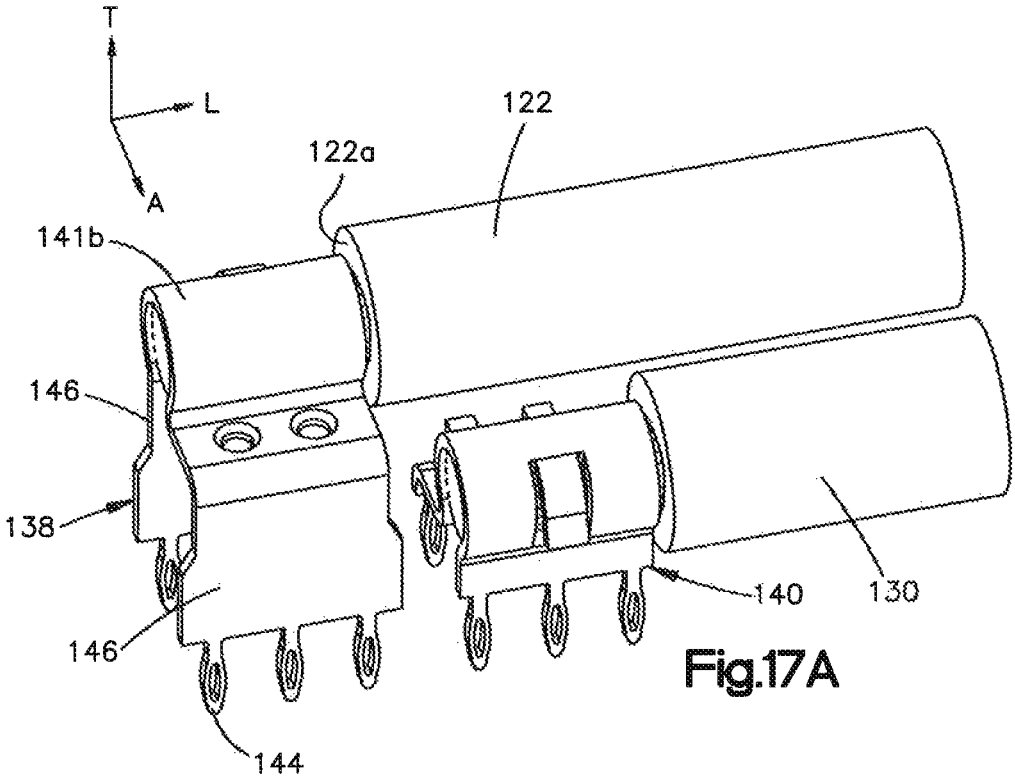
FIG. 17A is a perspective view of first and second terminal assemblies of the cable connector illustrated in FIG. 13A.
Figure 17B:
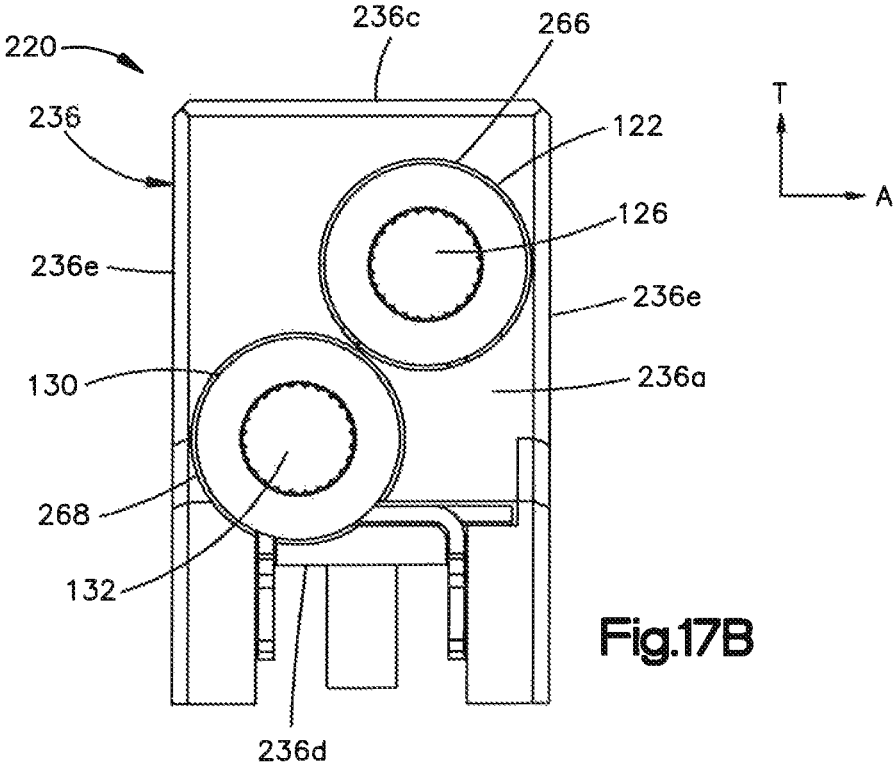
FIG. 17B is a front end elevation view of the cable connector illustrated in FIG. 13A.

Referring now also to FIGS. 6A-6C, a kit can include at least one second electrical connector 90. The second electrical connector 90 can be constructed as described in U.S. Pat. No. 7,331,800, the disclosure of which is hereby incorporated by reference as if set forth in its entirety herein. The second electrical connector 90 can include an electrically insulative second connector housing 91, a plurality of electrical signal contacts 92 and electrical ground contacts 93 supported by the connector housing 91, arranged in respective leadframe assemblies so as to define differential signal pairs along each of the respective leadframe assemblies. Ones of the ground contacts can be disposed between respective ones of the differential signal pairs. The signal contacts 92 and ground contacts 93 define mounting portions 94 as described above with the mounting portions of the electrical cable connector 20.

The kit can further include at least one electrical cable connector 20 as described above, such that the connector housing 36 and the connector housing 91 of the second electrical connector are identically dimensioned along the lateral direction A. That is, the connector housing 36 and the second electrical connector 90 can have an identical width. The identical width can be between approximately 8 mm and approximately 13 mm, such as between approximately 11 mm and 12 mm such as approximately 11.85 mm.

Further, the mounting portions 44 and 56 of the cable connector 20 can combine to define a first footprint. The mounting portions 94 of the signal contacts 92 and around contacts 93 of the second electrical connector 90 can define a second footprint that is equal to the first footprint. Thus, ones of the mounting portions of the first footprint can be spaced from each other along the lateral direction A a first distance, and ones of the mounting portions of the first footprint can be spaced from each other along a the longitudinal direction L a second distance. Similarly, ones of the mounting portions of the second footprint can be spaced from each other along the lateral direction A the first distance, and ones of the mounting portions of the second footprint can be spaced from each other along a the longitudinal direction L the second distance. Thus, the first and second footprints can be equally dimensioned in the lateral direction A and the longitudinal direction L. Accordingly, the second electrical connector and the cable connector 20 can be mounted to the same printed circuit board having the same dimensions and footprint on the printed circuit board. For instance, the mounting portions of the first footprint are positioned and configured to be inserted into a respective plurality of vias of the printed circuit board, and the mounting portions of the second footprint is positioned and configured to he inserted into the respective plurality of vias of the printed circuit board.

The housing 36 of the cable connector 20 can define a first length in the longitudinal direction L, and the housing 91 can have a second length from the front end to the opposed rear end that is greater than the first length. The first end of the housing 91 can define a mating interface that is configured to mate with a complementary electrical device so as to place the signal contacts 92 and ground contacts 93 in electrical communication with a complementary electrical device, such as a complementary electrical connector. The bottom of the housing 91 can define a mounting interface configured to face the printed circuit board when the housing 91 is mounted to the printed circuit board. The housing 36 can define a first height from the bottom 36*d* to the top 36*c*, and the housing 91 can define a second height from the bottom to the top that opposite the bottom, the second height equal to the first height. The first and second heights can be between approximately 10 mm and 20 mm at the respective mating interfaces, such as between approximately 13 mm and 16 mm, for instance approximately 14.7 mm. The first and second heights can be between approximately 15 mm and 25 mm at respective locations opposite the mating interfaces along the longitudinal direction L, such as between approximately 17 mm and 21 mm, for instance approximately 19.1 mm.

Referring again to FIGS. 1A-5, a method can be provided for installing the first and second terminal assemblies, including the first and second electrical terminals 38 and 40 and the first and second electrical cables 22 and 30, into the electrical cable connector housing 36. The method can include the step of mounting the first electrical conductor 26 of the first electrical cable 22 to the first surface 42*a* of the first terminal body 42 as described above. The method can further include the step of mounting the second electrical conductor 32 of the second electrical cable 30 to the second surface 54*b* of the second terminal body 54 as described above. The first surface 42*a* can face a first direction, and the second surface 54*b* can faces a second direction opposite the first surface when the first and second mounting portions 44 and 56 extend in the same direction, such that the first and second terminals 38 and 40 are aligned for insertion into the connector housing 36. The method can further include the step of inserting the first electrical terminal 38 into the connector housing 36 along a respective insertion direction such that the first electrical cable 22 extends out the connector housing 36. For instance, the first electrical terminal 38 is inserted in a direction from the second end 36*b* toward the first end 36*a*. The first electrical terminal 38 can be inserted into the third channel 74 as described above. The inserting step can further include the step of inserting the first electrical cable 22 in the direction from the second end 36*b* toward the first end 36*a* in the first channel 70. The method can further include the step of inserting the second electrical terminal 40 into the connector housing 36 along a respective insertion direction such that the second electrical cable 30 extends out the connector housing 36. For instance, the second electrical terminal 40 can be inserted into the second channel 72 in a direction from the first end 36*a* toward the second end 36*b*.

The first inserting step can include the step of pulling the first electrical terminal 38 into the connector housing 36. For example, the first electrical terminal 38 can be pulled along a direction in which the first electrical cable 22 extends from the first electrical terminal 38. First electrical terminal 38 can be inserted into the third channel 74 in a forward direction from the second end 36*b* toward the first end 36*a*. Thus, the first electrical cable 22 can first be inserted into the first channel 70 at the second end 36*b* in the forward direction such that the first electrical cable 22 extends through the first end 36*a*. Because the first cable 22 is mounted to the first surface 42*a* of the first terminal 38, the first terminal 38 is inserted into the third channel 74 as the first cable 22 is drawn through the first channel 70. The first terminal 38 can be inserted through the slot 80 that extends through the attachment wall 84 in the forward direction. For instance, the first terminal 38 can be inserted in the third channel 74 in the forward direction until the first terminal abuts the connector housing 36 at the end of the slot 80.

The second inserting step can include the step of pushing the second electrical terminal 40 into the connector housing 36 in a rearward direction opposite the forward direction. Thus, the second inserting step can include the step of pushing the second electrical terminal 40 into the connector housing 36 in a direction from the first end 36*a* toward the second end 36*b*. In particular, the second electrical terminal 40 is inserted into the second channel 72. Because the second electrical cable 30 is mounted to the second surface 54*b* of the second electrical terminal 40, the second electrical terminal 40 can be inserted into the second channel 72 such that the second electrical cable 30 extends out the second channel 72 at the first end 36*a*, for instance out the second opening 68.

Thus, each of the first and second electrical cables 22 and 30 can extend out from the connector housina 36 in the same direction, such as the forward direction. Further, the inserting steps can include the step of aligning the first electrical cable 22 with the second electrical cable 30 in the connector housing 36 along the transverse direction T. The method can further include the step of attaching the end wall 82 to the connector housing 36 so as to cover one of the channels. For instance, the end wall 82 can cover the first and third channels 70 and 74 at the second end 36*b* of the connector housing 36 in the manner described above. The inserting steps further include the step of causing the first and second at least one mounting portion of the electrical terminals 38 and 40 to extend out from the connector housing 36 in the downward direction.

Referring now to FIGS. 7A-12C, an electrical cable connector 120 constructed in accordance with another embodiment can include a first electrical cable 122 that defines a first end 122*a* and a second end opposite the first end. The first electrical cable 122 can include a first electrical conductor 126 and a first electrical insulator 128 that surrounds at least a portion of the first electrical conductor 126. The cable connector 120 can further include a second electrical cable 130 that defines a first end 130*a* and a second end opposite the first end 130*a*. The second electrical cable 130 can include a second electrical conductor 132 and a second electrical insulator 134 that surrounds at least a portion of the second electrical conductor 132. The second electrical insulator 134 can be separate from the first electrical insulator 128. The first and second electrical conductors 126 and 132 at the respective second ends of the first and second electrical cables 122 and 130, respectively, can be placed in electrical communication with a complementary electrical component, which can be a power source or a device configured to receive electrical power. In this regard, it should be appreciated that the first and second electrical cables 122 and 130 can be configured as electrical power cables. Alternatively, one of the first and second electrical cables 122 and 130 can be configured as a power cable, and the other of the first and second electrical cables 122 and 130 can be configured as a ground. For instance, the first electrical cable 122 can be configured as a power cable, and the second electrical cable 130 can be configured as a ground. The first and second electrical conductors 126 and 132 can include a plurality of stranded electrically conductive fibers of wire can be braided, twisted, or otherwise intertwined as desired. The fibers can be ultrasonically bonded, welded, or soldered to each other at one or both of the first and second ends so as to fuse the fibers of wire to each other.

The electrical cable connector 120 can further include a dielectric or electrically insulative connector housing 136, and first and second electrically conductive terminals 138 and 140 configured to be supported by the connector housing 136. The connector housing 136 can define a first end 136*a*, and a second end 136*b* opposite the first end 136*a* and spaced from the first end 136*a* along a longitudinal direction L. The first end 136*a* can be referred to as a front end, and the second end 136*b* can be referred to as a rear end. Thus, a forward direction can be defined along the longitudinal direction L from the second end 136*b* toward the first end 136*a*. A rearward direction can be defined along the longitudinal direction L from the first end 136*a* toward the second end 136*b*. The connector housing 136 can further define a top 136*c* and a bottom 136*d* opposite the top 136*c* and spaced from the top 136*c* along a transverse direction T that is substantially perpendicular to the longitudinal direction L. Thus, a downward direction can be defined along the transverse direction T from the top 136*c* toward the bottom 136*d*. An upward direction can be defined along the transverse direction T from the bottom 136*d* toward the top 136*c*. The connector housing 136 can further define opposed sides 136*e* that are spaced from each other along a lateral direction A that is substantially perpendicular to each of the longitudinal direction L and the transverse direction T. The first and second electrical cables 122 and 130 are configured to be physically and electrically connected to the first and second electrical terminals 138 and 140, respectively, such that when the first and second electrical terminals 138 and 140 are supported by the connector housing 136, each of the first and second electrical cables 122 and 130 can extend out the first end 136*a*.

The first electrical terminal 138 can include a first terminal body 142 undo first at least one mounting portion 144 that extends out from the first terminal body 142 and out the connector housing 136 in a first direction. For instance, the first direction can be a downward direction that extends along the transverse direction T. The first terminal body 142 can define a first receptacle 141 that can be substantially cylindrical in shape, or can define any suitable alternative shape as desired. The first receptacle 141 defines an inner surface 141*a* and an outer surface 141*b* opposite the inner surface. When the first electrical terminal 138 is supported by the connector housing 136, the first receptacle 141 can extend along a central axis that is oriented in the longitudinal direction L. Thus, as is described in more detail below, the first receptacle 141 is sized to receive the first electrical conductor 126 at the first end 122*a* of the first electrical cable 122 along the longitudinal direction L. The terminal body 142 can include first and second opposed walls 146 that are spaced from each other in the lateral direction A. In one example, the walk 146 can be substantially planar along the longitudinal direction L and the transverse direction T. The first terminal body 142 can further include a bridge member 150 connected between the first and second walls 146. The bridge member 150 can define the receptacle 141. The first at least one mounting portion 144 can extend out of the connector housing 136 through the bottom 136*d*. In one example, the first electrical terminal 138 can include a first pair of mounting portions 144 that extend from respective ones of the first and second walls 146. For instance, the first at least one mounting portion 144 can include a plurality of first mounting terminals 152 that project down from the first terminal body 142. For instance, the first mounting terminals 152 can project down from one or both of the first and second walls 146. The first mounting terminals 152 can be configured as press-fit tails, surface mounts, ball grid arrays, j-shaped leads, or any suitable alternatively constructed terminal configured to be placed in electrical communication with an underlying substrate, such as a printed circuit board. The first electrical terminal 138 can be stamped or otherwise formed as a single piece from a strip of suitable electrically conductive material as desired, such as a copper alloy. The terminal body 142 can be plated with a lead-free tin over nickel. The first at least one mounting portion 144 can be offset from the receptacle 141 a first distance along the transverse direction T. Further, the first electrical terminal 138 can define a first height along the transverse direction.

The second electrical terminal 140 can include a second terminal body 154 and a second at least one mounting portion 156 that extends out from the second terminal body 154 and out the connector housing 148 in the first direction. The second terminal body 154 can define a second receptacle 153 that can be substantially cylindrical in shape, or can define any suitable alternative shape as desired. The second receptacle 153 defines an inner surface 153*a* and an outer surface 153*b* opposite the inner surface. When the second electrical terminal 140 is supported by the connector housing 136, the second receptacle 153 can extend along a central axis that is oriented in the longitudinal direction L. Thus, as is described in more detail below, the second receptacle 153 is sized to receive the second electrical conductor 132 at the first end 130*a* of the second electrical cable 130 along the longitudinal direction L. The terminal body 154 can include first and second opposed walls 158 that are spaced from each other in the lateral direction A. In one example, a first one of the walls 158 can be substantially planar along the longitudinal direction L and the transverse direction T. A second one of the walls 158 can extend laterally outward with respect to the first one of the walls 158. For instance, the second one of the walls can be substantially planar in the longitudinal direction L and the lateral direction A. The second terminal body 154 can further include a second bridge member 162 connected between the second and second walls 158. The bridge member 162 can define the second receptacle 153. The second at least one mounting portion 156 can extend out of the connector housing 136 through the bottom 136*d*. In one example, the second electrical terminal 140 can include a second pair of mounting portions 156 that extend from respective ones of the first and second walls 158. For instance, the second at least one mounting portion 156 can include a plurality of second mounting terminals 164 that project down from the second terminal body 154. For instance, the second mounting terminals 164 can project down from one or both of the second and second walls 158. The second mounting terminals 164 can be configured as press-fit tails, surface mounts, ball grid arrays, j-shaped leads, or any suitable alternatively constructed terminal configured to be placed in electrical communication with an underlying substrate, such as a printed circuit board. The second electrical terminal 140 can be stamped or otherwise formed as a single piece from a strip of suitable electrically conductive material as desired, such as a copper alloy. The second electrical terminal 140 can be plated with a lead-free tin over nickel. The second at least one mounting portion 156 can be offset from the receptacle 153 a second distance along the transverse direction T that is less than the first distance. Further, the second electrical terminal 140 can define a second height along the transverse direction T that is less than the first height.

The first electrical cable 122, and in particular the first end 122*a* of the first electrical conductor 126, can be mounted to the first electrical terminal 138. Thus, the first electrical terminal 138, and in particular the first terminal body 142, is capable of being mounted to the first electrical conductor 126. In particular, the first electrical conductor 126 at the first end 122*a* can be inserted into the first receptacle 141 so as to face the inner surface 141*a* of the first receptacle 141. The first electrical conductor 126 can then be attached to the first electrical terminal 138. In one embodiment, the first electrical conductor 126 can be soldered to the inner surface 141*a* of the first receptacle 141. For instance, the first electrical conductor 126 can be exposed from the first electrical insulator 128, and coated with a tin. In one example, the exposed portion of the first electrical conductor 126 can be placed in a tinning dip, and coated with tin. Next, the exposed portion of the first electrical conductor 126 can be coated with a solder material. The exposed portion of the first electrical conductor 126 can then be inserted into the first receptacle 141, and heated to cause solder reflow, which bonds the first electrical conductor 126 to the inner surface 141*a* of the receptacle 141. It should be appreciated, of course, that the first electrical conductor 126 can be attached to the first electrical terminal 138 in accordance with any suitable alternative embodiment as desired. For instance, the first receptacle 141 can be crimped about the exposed portion of the first electrical conductor 126. Alternatively, the first electrical conductor 126 can be ultrasonically welded or otherwise attached to the first electrical terminal 138.

Similarly, the second electrical cable 130, and in particular the second electrical conductor 132 at the second end of the second electrical cable 130, can be mounted to the second electrical terminal 140. Thus, the second electrical terminal 140, and in particular the second terminal body 154, is capable of being mounted to the second electrical conductor 132. In particular, the second electrical conductor 132 at the second end of the second electrical cable 130, can be inserted into the second receptacle 153 so as to face the inner surface 153*a* of the second receptacle 153. The second electrical conductor 132 can then be attached to the second electrical terminal 140. In one embodiment, the second electrical conductor 132 can be soldered to the inner surface 153*a* of the second receptacle 153. For instance, the second electrical conductor 132 can be exposed from the second electrical insulator 134, and coated with a tin. In one example, the exposed portion of the second electrical conductor 132 can be placed in a tinning dip, and coated with tin. Next, the exposed portion of the second electrical conductor 132 can be coated with a solder material. The exposed portion of the second electrical conductor 132 can then be inserted into the second receptacle 153, and heated to cause solder reflow, which bonds the second electrical conductor 132 to the inner surface 153*a* of the receptacle 153. It should be appreciated, of course, that the second electrical conductor 132 can be attached to the second electrical terminal 140 in accordance with any suitable alternative embodiment as desired. For instance, the second receptacle 153 can be crimped about the exposed portion of the second electrical conductor 132. Alternatively, the second electrical conductor 132 can be ultrasonically welded or otherwise attached to the second electrical terminal 140.

The first and second electrical terminals 138 and 140, can be arranged in the connector housing 136 such that the second electrical terminal 140 is disposed between the first end 136*a* and the first electrical terminal 138, and the first electrical terminal 138 is disposed between the second electrical terminal 140 and the second end 136*b*. Alternatively, the first and second electrical terminals 138 and 140, can be arranged in the connector housing 136 such that the first electrical terminal 138 is disposed between the first end 136*a* and the second electrical terminal 140, and the second electrical terminal 140 is disposed between the first electrical terminal 138 and the second end 136*b*. The first and second mounting portions 144 and 156 can be aligned with each other along the longitudinal direction L when the first and second electrical terminals 138 and 140 are disposed in the connector housing 136.

When the first and second electrical terminals 138 and 140 are disposed in the connector housing 136 and the first and second electrical cables and 130 are attached to the first and second terminals 138 and 140, respectively, the first electrical cable 122 can be spaced from the second electrical cable 130 along a first direction, such as the transverse direction T, at a location between the first and second ends 136*a* and 136*b*. For instance, the first electrical cable 122 can be spaced from the bottom 136*d* a first distance, and the second electrical cable 130 can be spaced from the bottom 136*d* a second distance that is less than the first distance. Thus, the first electrical cable 122 can be an upper electrical cable, and the second electrical cable 130 can be a lower electrical cable. Of course, it should be appreciated that the first electrical cable 122 can be the lower electrical cable, and the second electrical cable 130 can be the upper electrical cable. Further, when the first and second electrical terminals 138 and 140 are disposed in the connector housing 136 and the first and second electrical cables 122 and 130 are attached to the first and second terminals 138 and 140, respectively, the first electrical cable 122 can be spaced from the second electrical cable 130 along a second direction perpendicular to the first direction between the first and second ends 36*a* and 36*b*. The second direction can be the lateral direction A.

The first and second cables 122 and 130 can exit the connector housing 136 at respective first and second openings 166 and 168 in one of the first and second ends 136*a* and 136*b*. For instance, the first and second openings 166 and 168 can be disposed at the first end 136*a*. The first opening 166 can extend through the first end 136*a* along a first central axis, and the second opening 168 can extend through the first end 136*a* along a second central axis. The first central axis can be spaced from the second central axis in the first direction. The first central axis can further be spaced from the second central axis in the second direction. The first central axis can be aligned with the second central axis in a direction that includes both the first direction and the second direction. Each of the first and second openings 166 and 168 can be disposed between the top 136*c* and bottom 136*d*, and can further be disposed between the opposed sides 136*e*.

The connector housing 136 can define a first channel 170 that extends through the connector housing 136 from the first end 136*a* to the second end 136*b*. For instance, the first channel 170 can define the first opening 166. Alternatively, the first channel 170 can define the second opening 168. The connector housing 136 can define a second channel 172 that extends into the connector housing 136 from the first end 136*a* toward the second end 136*b*. The second channel 172 can terminate between the first end 136*a* and the second end 136*b*. For instance, the second channel 172 can define the second opening 168 and can extend through the connector housing 136 from the second opening 168 toward the second end 136*b*. Alternatively, the second channel 172 can define the first opening 166. The connector housing 136 can include a divider wall 176 that defines an end of the second channel 172 at a location between the first end 136*a* and the second end 136*b*.

The second channel 172, and thus the connector housing 136, can define a first at least one slot 178 that extends through the bottom 136*d*. Accordingly, a portion of the second electrical terminal 140 can extend through the first at least one slot 178 in the first direction, such that the second at least one mounting portion 156 extends through the first at least one slot 178 and out from the bottom 136*d* in the first direction. For instance, the first at least one slot 178 can include a pair of slots 178 that are spaced from each other in the lateral direction A. The walls 158 can be aligned with respective ones of the slots 178. Accordingly, the walls, the mounting portions 156, or both, can extend through the slots 178 and out the connector housing 136. The second electrical cable 130 can extend from the second electrical terminal 140, and in particular from the second receptacle 153, through the second channel 172, and out the second opening 168.

The connector housing 136 can define a third channel 174 that extends from the second end 136*b* toward the first end 136*a*. The third channel 174 can define a second at least one slot 180 that extends through the bottom 36*d*. The divider wall 176 can be disposed between the second channel 172 and the third channel 174. The third channel 174 can be open to the first channel 170. For instance, the third channel 174 can be open to the first channel 170 along a direction that includes the transverse direction T and the lateral direction A. A portion of the first terminal body 142 can be disposed in the first channel 170. A portion of the first terminal body 142 can further be disposed in the third channel 174. Accordingly, a portion of the first terminal body 142 can extend through the second at least one slot 180 in the first direction. For instance, the first at least one mounting portion 144 can extend through the second at least one slot 180 and out from the bottom 136*d* in the first direction. The first and second mounting portions 144 and 156 can be coplanar with each other. For instance, the second at least one slot 180 can include a pair of slots 180 that are spaced from each other in the lateral direction A. The walls 146 can be aligned with respective ones of the slots 180. Accordingly, the walls 146, the mounting portions 144, or both, can extend through the slots 180 and out the connector housing 136. The first electrical cable 122 can extend from the first electrical terminal 138, and in particular from the first receptacle 141, through the first channel 170, and out the first opening 166 at the first end 136*a* of the connector housing 136.

The electrical cable connector 120 can further include an end wall 182 that is configured to cover at least the first channel 170 at the second end 136*b* of the connector housing 136. For instance, the end wall 182 is configured to be in a first position whereby the end wall 182 covers the first and third channels 170 and 174 at the second end 136*b* and a second position whereby the end wall 182 is out of alignment with the first and third channels 170 and 174 at the second end 136*b*. Accordingly, when end wall 182 is in the second position, a first terminal assembly that includes the first electrical terminal 138 and the first electrical cable 122 can be inserted into the connector housing 136 through the second end 136*b* along a direction toward the first end 136*a*, as is described in more detail below. When the end wall 182 is in the first position, the end wall 182 interferes with the first terminal assembly so as to render the first terminal assembly touch proof, and to further prevent the first terminal assembly from travelling out the second end 136*b* of the connector housing 136. In one example, the end wall 182 can be removable from the connector housing 136, such that the end wall is in the first position when the end wall 182 is attached to the connector housing 136, and in the second position when the end wall 182 is removed from the connector housing. Alternatively, the end wall 182 can be attached to the housing 136, and movable with respect to the connector housing 136 between the first and second positions. For instance, the end wall 182 can be hingedly attached to the housing 136, slidably attached to the housing 136, or otherwise movably or fixedly attached to the housing 136.

In accordance with the illustrated example, the end wall 182 and the connector housing 136 have complementary engagement members that are received in each other when the end wall 182 is attached to second end 136*b* of the connector housing 136. For instance, the connector housing 136 can include an attachment wall 184 at the second end 136*b*. The attachment wall 184 can cover a portion of the first channel 170 and the third channel 174 at the second end 136*b*. The second slots 180 can extend through the attachment wall 184 such that the first terminal assembly can be inserted into the connector housing 136 through the second end 136*b* along a direction toward the first end 136*a*. Each of the first and second terminals 138 and 140 can include retention barbs 186 that flare laterally outward from one or both of the walls so as to press-fit or otherwise interfere with the connector housing 136 when the terminals are inserted in the connector housing 136, thereby resisting or preventing back- of the respective electrical terminal out the connector housing 136 in a direction opposite the insertion direction of the electrical terminal into the connector housing. The end wall 182 can define a support arm 185 that projects along the longitudinal direction from the second end 136*b* toward the first end 136*a*. The support arm 185 can be disposed between the outer surface 141*b* of the retainer and the top 36*c* of the housing 36. For instance, the support arm 185 can be in abutment with the outer surface 141*b*, so as to provide structure support to the second electrical terminal 140 as the second electrical terminal 140 is mounted to the underlying printed circuit board. The support arm 185 can be arcuate or otherwise shaped as desired. For instance, the support arm 185 can be concave with respect to the bottom end 136*d* of the connector housing 136.

As illustrated in FIG. 6, a kit can include the at least one second electrical connector 90 as described above. The kit can further include at least one electrical cable connector 120, such that the connector housing 136 and the connector housing 91 of the second electrical connector are identically dimensioned along the lateral direction A. That is, the connector housing 136 and the second electrical connector 90 can have an identical width. Further, the first and second mounting portions 144 and 156 can combine to define a first footprint, and the mounting portions of the signal contacts 92 and ground contacts 93 can define a second footprint that is equal to the first footprint. Thus, ones of the mounting portions of the first footprint can be spaced from each other along the lateral direction A a first distance, and ones of the mounting portions of the first footprint can be spaced from each other along a the longitudinal direction L a second distance. Similarly, ones of the mounting portions of the second footprint can be spaced from each other along the lateral direction A the first distance, and ones of the mounting portions of the second footprint can be spaced from each other along a the longitudinal direction L the second distance. Thus, the first and second footprints can be equally dimensioned in the lateral direction A and the longitudinal direction L. Accordingly, the second electrical connector and the cable connector 120 can be mounted to the same printed circuit board having the same dimensions and footprint on the printed circuit board. For instance, the mounting portions of the first footprint are positioned and configured to be inserted into a respective plurality of vias of the printed circuit board, and the mounting portions of the second footprint is positioned and configured to be inserted into the respective plurality of vias of the printed circuit board. The housing 136 of the cable connector 120 can define a first length in the longitudinal direction L, and the housing 91 can have a second length from the front end to the opposed rear end that is greater than the first length. The first end of the housing 91 can define a mating interface that is configured to mate with a complementary electrical device so as to place the signal contacts 92 and ground contacts 93 in electrical communication with a complementary electrical device, such as a complementary electrical connector. The bottom of the housing 91 can define a mounting interface configured to face the printed circuit board when the housing 91 is mounted to the printed circuit board. The housing 136 can define a first height from the bottom 136*d* to the top 136*c*, and the housing 91 can define a second height from the bottom to the top that opposite the bottom, the second height equal to the first height.

Referring again to FIGS. 7A-12C, a method can be provided for installing the first and second terminal assemblies, including the first and second electrical terminals 138 and 140 and the first and second electrical cables 122 and 130, into the electrical cable connector housing 136. The method can include the step of mounting the first electrical conductor 126 of the first electrical cable 122 to the first electrical terminal 138 to define the first terminal assembly as described above. The method can further include the step of mounting the second electrical conductor 132 of the second electrical cable 130 to the second electrical terminal body 140 to define the second terminal assembly as described above. The method can further include the step of inserting the first electrical terminal 138 into the connector housing 136 along a respective insertion direction such that the first electrical cable 122 extends out the connector housing 136. For instance, the first electrical terminal 138 is inserted in a direction from the second end 136*b* toward the first end 136*a*. The first electrical terminal 138 can be inserted into the first and third channels 170 and 174 as described above. For instance, the first and second walls 146 can be inserted into the third channel 174, and the first receptacle 141 can be inserted into the first channel 170. The inserting step can further include the step of inserting the first electrical cable 122 in the direction from the second end 136*b* toward the first end 136*a* in the first channel 170. The method can further include the step of inserting the second electrical terminal 140 into the connector housing 136 along a respective insertion direction such that the second electrical cable 130 extends out the connector housing 136. For instance, the second electrical terminal 140 can be inserted into the second channel 172 in a direction from the first end 136*a* toward the second end 136*b*.

The first inserting step can include the step of pulling the first electrical terminal 138 into the connector housing 136. For example, the first electrical terminal 138 can be pulled along a direction in which the first electrical cable 122 extends from the first electrical terminal 138. The first electrical terminal 138 can be inserted into the first and third channels 70 and 74 in a forward direction from the second end 136*b* toward the first end 136*a*. Thus, the first electrical cable 122 can first be inserted into the first channel 170 at the second end 136*b* in the forward direction such that the first electrical cable 122 extends through the first end 136*a*. Because the first cable 122 is mounted to the first electrical terminal 138, the first electrical terminal 138 is inserted into the first and third channels 70 and 74 as the first cable 122 is drawn through the first channel 170. The first electrical terminal 138 can be inserted through the slot 180 that extends through the attachment wall 184 in the forward direction. For instance, the first electrical terminal 138 can be inserted in the third channel 174 in the forward direction until the first terminal abuts the connector housing 136 at the end of the slot 180.

The second inserting step can include the step of pushing the second electrical terminal 140 into the connector housing 136 in a rearward direction opposite the forward direction. Thus, the second inserting step can include the step of pushing the second electrical terminal 140 into the connector housing 136 in a direction from the first end 136*a* toward the second end 136*b*. In particular, the second electrical terminal 140 is inserted into the second channel 172. Because the second electrical cable 130 is mounted to the second electrical terminal 140, the second electrical terminal 140 can be inserted into the second channel 172 such that the second electrical cable 130 extends out the second channel 172 at the first end 136*a*, for instance out the second opening 68.

Thus, each of the first and second electrical cables 122 and 130 can extend out from the connector housing 136 in the same direction, such as the forward direction. Further, the inserting steps can include the step of aligning the first electrical cable 122 with the second electrical cable 130 in the connector housing 136 along a direction that includes the transverse direction T and the lateral direction A. The method can further include the step of attaching the end wall 182 to the connector housing 136 so as to cover one of the channels. For instance, the end wall 182 can cover the first and third channels 170 and 174 at the second end 136*b* of the connector housing 136 in the manner described above. The inserting steps further include the step of causing the first and second at least one mounting portion of the electrical terminals 138 and 140 to extend out from the connector housing 136 in the downward direction.

Referring now to FIGS. 13A-17B, an electrical cable connector 220 constructed in accordance with another embodiment can include the first electrical cable 122 and the second electrical cable 130 as described above. The electrical cable connector 220 can further include the first and second electrical terminals 138 and 140 as described above.

The electrical cable connector 220 can further include a dielectric or electrically insulative connector housing 236. The connector housing 236 can define a first end 236*a*, and a second end 236*b* opposite the first end 236*a* and spaced from the first end 236*a* along a longitudinal direction L. The first end 236*a* can be referred to as a front end, and the second end 236*b* can be referred to as a rear end. Thus, a forward direction can be defined along the longitudinal direction L from the second end 236*b* toward the first end 236*a*. A rearward direction can be defined along the longitudinal direction L from the first end 236*a* toward the second end 236*b*. The connector housing 236 can further define a top 236*c* and a bottom 236*d* opposite the top 236*c* and spaced from the top 236*c* along a transverse direction T that is substantially perpendicular to the longitudinal direction L. Thus, a downward direction can be defined along the transverse direction T from the top 236*c* toward the bottom 236*d*. An upward direction can be defined along the transverse direction T from the bottom 236*d* toward the top 236*c*. The connector housing 236 can further define opposed sides 236*e* that are spaced from each other along a lateral direction A that is substantially perpendicular to each of the longitudinal direction L and the transverse direction T. The first and second electrical cables 222 and 230 are configured to be physically and electrically connected to the first and second electrical terminals 138 and 140, respectively, such that when the first and second electrical terminals 138 and 140 are supported by the connector housing 236, each of the first and second electrical cables 122 and 130 can extend out the first end 236*a*.

The connector housing 236 can define a first channel 270 that extends at least into the connector housing 236 from the first end 236*a* toward the second end 236*b*. The first channel 270 can further extend through the connector housing 236 from the first end 236*a* to the second end 236*b*. The first channel 270 can define a first opening 266 at the first end 236*a*. The connector housing 236 can define a second channel 272 that extends into the connector housing 236 from the first end 236*a* toward the second end 236*b*. Thus, each of the first and second channels 270 and 272 can extend at least into the connector housing along the longitudinal direction L. The second channel 272 can terminate between the first end 236*a* and the second end 236*b*. For instance, the second channel 272 can define a second opening 268 disposed at the first end 236*a*. Alternatively, the second channel 272 can define the first opening 266, and the first channel 270 can define the second opening 268. The first and second openings 266 and 268 can be aligned from each other along a direction that includes the transverse direction T and the lateral direction A. Thus, the first and second openings 266 and 268 can be spaced from each other in both the lateral direction A and the transverse direction T. The connector housing 236 can include a divider wall 276 that defines an end of the second channel 272 at a location between the first end 236*a* and the second end 236*b*.

The connector housing 236 can define a third channel 274 that extends into the housing 236 along a direction that is perpendicular to the longitudinal direction L. For instance, the third channel 274 can extend into the connector housing 236 along the transverse direction T. In one example, the third channel 274 can extend through the bottom 236*d* in the upward direction toward the top 236*c*. Thus, the third channel 274 can define a third opening 269 in the bottom 236*d* of the housing 236. The third channel 274 can be open to the first channel 270. The third channel 274 can define a width in the lateral direction A that is no less than the distance between the first and second walls 158 along the lateral direction A. The third channel 274 can have a length in the longitudinal direction L that is no less than the length of the second electrical terminal 140. The connector housing 236 can define a shelf 237 that at least partially defines the third channel 274. The connector housing 236 can further include at least one projection 243 that can be configured as a heat stake, as is described in more detail below. That is, the projection 243 is configured to deform when heated. The projection 243 can extend from the shelf 237 in the downward direction toward the bottom 236*d* of the connector housing 236.

The second channel 272, and thus the connector housing 236, can define a first at least one slot 278 that extends through the bottom 236*d*. Accordingly, a portion of the second electrical terminal 140 can extend through the first at least one slot 278 in the first direction, such that the second at least one mounting portion 156 extends through the first at least one slot 278 and out from the bottom 236*d* in the first direction. For instance, the first at least one slot 278 can include a pair of slots 278 that are spaced from each other in the lateral direction A. The walls 158 can be aligned with respective ones of the slots 278. Accordingly, the walls, the mounting portions 156, or both, can extend through the slots 278 and out the connector housing 236. The second electrical cable 230 can extend from the second electrical terminal 140, and in particular from the second receptacle 153, through the second channel 272, and out the second opening 268.

The third channel 274 can define a second at least one slot 280 that extends through the bottom 236*d*. The divider wall 276 can be disposed between the second channel 272 and the third channel 274. The third channel 274 can be open to the first channel 270. For instance, a first portion of the third channel 274 can be open to the first channel 270 along the transverse direction T. A portion of the first terminal body 142 can be disposed in the first channel 270. For instance, the receptacle 141 can be disposed in the first channel 270. Another portion of the first terminal body 142 can further be disposed in the third channel 274. For instance, at least a portion of at least one of the walls 246 can be disposed in the third channel 274. Accordingly, a portion of the first electrical terminal body 142 can extend through the second at least one slot 280 in the first direction. For instance, the first at least one mounting portion 144 can extend through the second at least one slot 280 and out from the bottom 236*d* in the first direction. The first and second mounting portions 144 and 156 can be coplanar with each other. For instance, the first at least one slot 280 can include a pair of slots 280 that are spaced from each other in the lateral direction A. The walls 246 can be aligned with respective ones of the slots 280. Accordingly, the walls 246, the mounting portions 144, or both, can extend through the slots 280 and out the connector housing 236. The first electrical cable 222 can extend from the first electrical terminal 138, and in particular from the first receptacle 141, through the first channel 270, and out the first opening 266 at the first end 236*a* of the connector housing 236.

The first electrical cable 122, and in particular the first end 122*a* of the first electrical conductor 126, can be mounted to the first electrical terminal 138. Thus, the first electrical terminal 138, and in particular the first terminal body 142, is capable of being mounted to the first electrical conductor 126. In particular, the first electrical conductor 126 at the first end 122*a* can be inserted into the first receptacle 141 so as to face the inner surface 141*a* of the first receptacle 141. The first electrical terminal 138 can be inserted in a respective insertion direction through the third opening 269 in the bottom 236*d*, and into the third channel 274 in the upward direction, along the transverse direction T until the first receptacle 141 is disposed in the first channel 270. The first and second opposed walls 146 of the first electrical terminal 138 can be are spaced from each other in the lateral direction A as described above. In one example, a first one of the walls 158 can be substantially planar along the longitudinal direction L and the transverse direction T. A second one of the walls 158 can have a first portion that extends laterally outward with respect to the first one of the walls 158. For instance, the first portion of the second one of the walls 158 can be substantially planar in the longitudinal direction L and the lateral direction A. The second one of the walls 158 can have a second portion that extends from the first portion. For instance, the second portion can extend down from the first portion. The second portion can thus be planar along the longitudinal direction L and the transverse direction T. The first electrical terminal 138 can define at least one aperture 139, such as a plurality of apertures 139, that extends through one of the walls 158. For instance, the apertures 139 can extend through the second one of the walls 158. In one example, the apertures 139 can extend through the first portion of the second one of the walls 158 in the transverse direction T. When the first electrical terminal 138 is inserted into the connector housing 236, the first electrical terminal 138 can be heat staked to the connector housing 236. For instance, the apertures 139 can receive respective ones of the projections 243. Next, heat can be applied to the projections 243 such that the projections 243 each deform so as to define a deformed region that is positioned such that the first electrical terminal 138 is captured between the deformed regions and the shelf 237. It should be appreciated that any location of the first electrical terminal 138 can define apertures configured to receive the projections of the housing 236 so as to be heat staked to the connector housing 236. Further, it should be appreciated that any of the electrical terminals 38, 40, 138, and 140, can defined apertures configured to receive projections of the connector housing so as to be heat staked to the connector housing.

After the first electrical terminal 138 has been inserted into the connector housing 236, the first electrical conductor 126 can be attached to the first electrical terminal 138. For instance, the first electrical cable 122 can be inserted into the first opening 266 in the rearward direction from the first end 36*a* toward the second end 236*b* in the first channel 270 until the first electrical conductor 126 at the first end 122*a* is inserted into the first receptacle 141. Next, the first electrical conductor 126 can be soldered to the inner surface 141*a* of the first receptacle 141 in the manner described above. For instance, the first electrical conductor 126 can be exposed from the first electrical insulator 128, and coated with a tin. In one example, the exposed portion of the first electrical conductor 126 can be placed in a tinning dip, and coated with tin. Next, the exposed portion of the first electrical conductor 126 can be coated with a solder material. The exposed portion of the first electrical conductor 126 can then be inserted into the first receptacle 141, and heated to cause solder reflow, which bonds the first electrical conductor 126 to the inner surface 141*a* of the receptacle 141. Thus, the first electrical conductor 126 can be soldered to the inner surface 141*a* of the first receptacle 141 after the first electrical terminal 138 has been inserted into the connector housing 236. Alternatively, the first electrical conductor 126 can be ultrasonically welded to the first receptacle 141 after the first electrical terminal 138 has been inserted into the connector housing 236.

The second electrical cable 130, and in particular the second electrical conductor 132 at the second end of the second electrical cable 130, can be mounted to the second electrical terminal 140. Thus, the second electrical terminal 140, and in particular the second terminal body 154, is capable of being mounted to the second electrical conductor 132. In particular, the second electrical conductor 132 can be inserted into the second receptacle 153 so as to face the inner surface 153*a* of the second receptacle 153. The second electrical conductor 132 can then be attached to the second electrical terminal 140. In one embodiment, as described above, the second electrical conductor 132 can be soldered to the inner surface 153*a* of the second receptacle 153. For instance, the second electrical conductor 132 can be exposed from the second electrical insulator 134, and coated with a tin. In one example, the exposed portion of the second electrical conductor 132 can be placed in a tinning dip, and coated with tin. Next, the exposed portion of the second electrical conductor 132 can be coated with a solder material. The exposed portion of the second electrical conductor 132 can then be inserted into the second receptacle 153, and heated to cause solder reflow, which bonds the second electrical conductor 132 to the inner surface 153*a* of the receptacle 153. It should be appreciated, of course, that the second electrical conductor 132 can be attached to the second electrical terminal 140 in accordance with any suitable alternative embodiment as desired. For instance, the second receptacle 153 can be crimped about the exposed portion of the second electrical conductor 132. Alternatively, the second electrical conductor 132 can be ultrasonically welded or otherwise attached to the second electrical terminal 140. The second terminal assembly can then be inserted through the second opening 168 and into the second channel 172 such that the mounting portions of the second electrical terminal 140 extend down from the connector housing 6 in the manner described above with respect to the connector housing 136.

The first and second electrical terminals 138 and 140, can be arranged in the connector housing 236 as described above with respect to FIGS. 7A-12C. For instance, the second electrical terminal 140 can be disposed between the first end 236*a* and the first electrical terminal 138, and the first electrical terminal 138 can be disposed between the second electrical terminal 140 and the second end 236*b*. Alternatively, the first and second electrical terminals 138 and 140, can be arranged in the connector housing 236 such that the first electrical terminal 138 is disposed between the first end 236*a* and the second electrical terminal 140, and the second electrical terminal 140 is disposed between the first electrical terminal 138 and the second end 236*b*. The first and second mounting portions 144 and 156 can be aligned with each other along the longitudinal direction L when the first and second electrical terminals 138 and 140 are disposed in the connector housing 236.

When the first and second electrical terminals 138 and 140 are disposed in the connector housing 236 and the first and second electrical cables 122 and 130 are attached to the first and second terminals 138 and 140, respectively, the first electrical cable 122 can be spaced from the second electrical cable 130 along a first direction, such as the transverse direction T, at a location between the first and second ends 236*a* and 236*b*. For instance, the first electrical cable 122 can be spaced from the bottom 236*d* a first distance, and the second electrical cable 130 can be spaced from the bottom 236*d* a second distance that is less than the first distance. Thus, the first electrical cable 122 can be referred to as an upper electrical cable, and the second electrical cable 130 can be referred to as a lower electrical cable. Of course, it should he appreciated that the first electrical cable 122 can be the lower electrical cable, and the second electrical cable 130 can be the upper electrical cable. Further, when the first and second electrical terminals 138 and 140 are disposed in the connector housing 236 and the First and second electrical cables 122 and 130 are attached to the first and second terminals 138 and 140, respectively, the first electrical cable 122 can be spaced from the second electrical cable 130 along a second direction perpendicular to the first direction between the first and second ends 236*a* and 236*b*. The second direction can be the lateral direction A.

The first and second cables 122 and 130 can exit the connector housing 236 at respective first and second openings 266 and 268 in one of the first and second ends 236*a* and 236*b*, such as the first end 236*a*. The first opening 266 can extend through the first end 236*a* along a first central axis, and the second opening 268 can extend through the first end 236*a* along a second central axis. The first central axis can be spaced from the second central axis in the first direction, such as the transverse direction T. The first central axis can further be spaced from the second central axis in the second direction, such as the lateral direction A. The first central axis can be aligned with the second central axis in a direction that includes both the first direction and the second direction. Each of the first and second openings 266 and 268 can be disposed between the top 236*c* and bottom 236*d*, and can further be disposed between the first and second sides 236*e*.

Because the electrical cable connector 220 can be constructed such that neither the first electrical terminal nor the first electrical cable 122 is inserted into the connector housing 236 through the second end 236*b*, the second end 236*b* can define the end wall 282 that closes the first channel 270. Thus, the electrical cable connector 220 can be constructed such that the wall at the second end 236*b* is monolithic with the connector housing 236.

As described above with respect to FIG. 6, a kit can include at least one second electrical connector 90 of the type described in U.S. Pat. No. 7,331,800, the disclosure of which is hereby incorporated by reference as if set forth in its entirety herein. The second electrical connector 90 can include an electrically insulative second connector housing 91, a plurality of electrical signal contacts 92 and electrical ground contacts 93 supported by the connector housing 91, arranged in respective leadframe assemblies so as to define differential signal pairs along each of the respective leadframe assemblies. Ones of the ground contacts can be disposed between respective ones of the differential signal pairs. The signal contacts 92 and ground contacts 93 define mounting portions 94 as described above with the mounting portions of the electrical cable connector 20.

The kit can further include at least one electrical able connector 220, such that the connector housing 236 and the connector housing 91 of the second electrical connector are identically dimensioned along the lateral direction A. That is, the connector housing 236 and the second electrical connector 90 can have an identical width. Further, the mounting portions 144 and 156 can combine to define a first footprint, and the mounting portions of the signal contacts 92 and ground contacts 93 can define a second footprint that is equal to the first footprint. Thus, ones of the mounting portions of the first footprint can be spaced from each other along the lateral direction A a first distance, and ones of the mounting portions of the first footprint can be spaced from each other along a the longitudinal direction Lm second distance. Similarly, ones of the mounting portions of the second footprint can be spaced from each other along the lateral direction A the first distance, and ones of the mounting portions of the second footprint can be spaced from each other along a the longitudinal direction L the second distance. Thus, the first and second footprints can be equally dimensioned in the lateral direction A and the longitudinal direction L. Accordingly, the second electrical connector and the cable connector 20 can be mounted to the same printed circuit board having the same dimensions and footprint on the printed circuit board. For instance, the mounting portions of the first footprint are positioned and configured to be inserted into a respective plurality of vias of the printed circuit board, and the mounting portions of the second footprint is positioned and configured to be inserted into the respective plurality of vias of the printed circuit board. The housing 36 of the cable connector 20 can define a first length in the longitudinal direction L, and the housing 91 can have a second length from the front end to the opposed rear end along the longitudinal direction that is greater than the first length. The first end of the housing 91 can define a mating interface that is configured to mate with a complementary electrical device so as to place the signal contacts 92 and ground contacts 93 in electrical communication with a complementary electrical device, such as a complementary electrical connector. The housing 36 can define a first height from the bottom 36*d* to the top 36*c*, and the housing 91 can define a second height from the bottom to the top that opposite the bottom, the second height equal to the first height. The bottom of the housing 91 can define a mounting interface configured to face the printed circuit board when the housing 91 is mounted to the printed circuit board.

Referring again to FIGS. 13A-17B, a method can be provided for installing. the first and second terminal assemblies, including the first and second electrical terminals 138 and 140 and the first and second electrical cables 122 and 130, into the electrical cable connector housing 236. The method can include the step of inserting the first electrical terminal 138 through the third opening until a portion of the first electrical terminal 138 is disposed in the first channel 170, a second portion of the first electrical terminal 138 is disposed in the third channel 274, and the mounting portion 144 extends out the connector housing 236. In particular, the first receptacle 141 travels through the third opening 269, through the third channel 274, and into the first channel 270. The walls 146 travel through the third opening 269 and into the third channel 274. The first electrical terminal 138 can be inserted into the connector housing 236 until the apertures 139 receive respective ones of the projections 243. Next, heat can be applied to the projections 243 such that the projections 243 each deform so as to define a deformed region that is positioned such that the first electrical terminal 138 is captured between the deformed regions and the shelf 237. The first electrical cable 122 can be inserted into the first opening 266 in the rearward direction until the first electrical conductor 126 is inserted into the first receptacle 141. The first electrical conductor 126 can then be soldered, welded, or otherwise attached to the first electrical terminal 138 in the manner described above.

The method can further include the step of mounting the second electrical conductor 132 of the second electrical cable 130 to the second electrical terminal body 140 to define the second terminal assembly as described above. The method can further include the step of inserting the second electrical terminal 140 into the connector housing 236 such that the second electrical cable 130 extends out the connector housing 236. For instance, the second electrical terminal 140 can be inserted through the second opening 268 and into the second channel 272 in the rearward direction from the first end 236*a* toward the second end 236*b* such that the second mounting portion 156 extends out the bottom 236*d* of the connector housing 236. It should be appreciated that the step of inserting the second electrical terminal 140 can be performed before or after the first electrical terminal 138 is inserted into the housing 236. Further, it should be appreciated that the step of inserting the second electrical terminal 140 can be performed before or after the first electrical cable 122 is attached to the first electrical terminal 138.

The first inserting step can include the step of pushing the first electrical terminal 138 into the connector housing 236. For example, the first electrical terminal 138 can he pushed along a direction perpendicular to a direction in which the first electrical cable 122 extends from the first electrical terminal 138. The first electrical terminal 138 can be inserted into the third and first channels 274 and 270 in an upward direction from the bottom 236*d* toward the top 236*c*. The second inserting step can include the step of pushing the second electrical terminal 140 into the connector housing 236 in a rearward direction opposite the forward direction. Thus, the second inserting step can include the step of pushing the second electrical terminal 140 into the connector housing 236 in a direction from the first end 236*a* toward the second end 236*b*. In particular, the second electrical terminal 140 is inserted into the second channel 272. Because the second electrical cable 130 is mounted to the second electrical terminal 140, the second electrical terminal 140 can be inserted into the second channel 272 such that the second electrical cable 130 extends out the second channel 272 at the first end 236*a*, for instance out the second opening 268.

Thus, each of the first and second electrical cables 122 and 130 can extend out from the connector housing 236 in the same direction, such as the forward direction. Further, the method can include the step of aligning the first electrical cable 122 with the second electrical cable 130 in the connector housing 236 along a direction that includes the transverse direction T and the lateral direction A. The inserting steps further include the step of causing the first and second at least one mounting portion of the electrical terminals 138 and 140 to extend out from the connector housing 236 in the downward direction.

In summary, the above disclosure includes two stacked cables that are each respectively attached to respective identical electrical terminals, with a first one of the electrical terminals being rotated 180 degrees with respect to the second terminal and both terminals being attached to a common substrate. Identical can mean equal heights, equal widths, equal depths (all within manufacturing tolerance), or any combinations of these dimensions. One of the electrical terminals can be positioned completely behind and adjacent to a second electrical terminal in an insertion direction that is parallel to the substrate. The one of the electrical terminals can be positioned on a common line with respect to the second electrical terminal, wherein the common line is oriented along the insertion direction. The second terminal can be electrically isolated from the first electrical terminal. Respective cables may be positioned in an over/under configuration with respect to one another and to a common housing that carries the first and second electrical terminals, with one cable attached to a top surface of the first electrical terminal and a second cable positioned on a bottom surface of a second electrical terminal. Alternatively, the one cable can be attached to the first terminal at a first location on the first terminal and the second cable can be attached to the second terminal at a second location that is not common with the first location, i.e. the cables are not attached at the same spots or surfaces on the respective first and second electrical terminals. Attachment can mean by soldering, ultrasonic welding, or insulation displacement. Attachment can also exclude insulation displacement. The respective cables may be offset from each other with respect to an axis that extends in a direction normal to the insertion direction. Both electrical terminals can be carried by a common electrical housing.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. For instance, it should be appreciated that structure and methods described in association with one embodiment are equally applicable to all other embodiments described herein unless otherwise indicated. Those skilled in the relevant art, having the benefit of the teachings of this specification, may effect numerous modifications to the invention as described herein, and changes may be made without departing from the spirit and scope of the invention, for instance as set forth by the appended claims.

What is claimed is:

1. An electrical cable connector comprising:

an electrically insulative connector housing;

a first electrical cable including a first electrical conductor;

a second electrical cable including a second electrical conductor, wherein the second electrical cable is an electrical power cable;

a first electrical terminal including a first terminal body attached to the first electrical conductor, and a first plurality of contact tails that extend out from the first terminal body and out of the connector housing in a first direction, wherein the first plurality of contact tails are configured to be mounted to a printed circuit board; and a second electrical terminal including a second terminal body attached to the second electrical conductor, and a second plurality of contact tails that extend out from the second terminal body and out of the connector housing in the first direction, wherein the second plurality of contact tails are configured to be mounted to the printed circuit board;

wherein the first electrical cable is offset from the second electrical cable in the first direction.

2. The electrical cable connector as recited in claim 1, wherein the connector housing comprises a top, bottom opposite the top, a first end, a second end opposite the first end, and opposed sides, and each of the first and second electrical cables extend out the first end, and the first plurality of contact tails and the second plurality of contact tails extend through the bottom.

3. The electrical cable connector as recited in claim 1, wherein 1) the connector housing has an identical width as a second electrical connector housing of a second electrical connector, wherein the second electrical connector housing supports a plurality of electrical signal contacts and a plurality of electrical ground contacts, and 2) the mounting portions of the first and second electrical terminals combine to define a first footprint, and mounting portions of the ground contacts and signal contacts combine to define a second footprint that is identical to the first footprint.

4. The electrical cable connector as recited in claim 1, wherein the first and second electrical terminals are formed as single pieces and identical to each other.

5. The electrical cable connector as recited in claim 2, wherein the first electrical cable is further spaced from the second electrical cable along a lateral direction perpendicular to the first direction.

6. The electrical cable connector as recited in claim 1, wherein the first electrical terminal has a first height in the first direction, the second electrical terminal has a second height in the first direction, and the first height is greater than the second height.

7. The electrical cable connector as recited in claim 6, wherein the first and second electrical terminals comprise first and second receptacles that receive the first and second electrical conductors, respectively.

8. The electrical cable connector as recited in claim 1, wherein the first electrical cable is a first electrical ground cable.

9. A kit comprising at least one electrical cable connector as recited in claim 3, and the second electrical connector.

10. The electrical cable connector of claim 1, wherein the first terminal body comprises a first surface and a second surface opposite the first surface and spaced from the first surface in the first direction, the second terminal body comprises a first surface and a second surface opposite the first surface and spaced from the first surface in the first direction, the first electrical conductor is mounted to the first surface of the first electrical terminal, and the second electrical conductor is mounted to the second surface of the second electrical terminal.

11. The electrical cable connector as recited in claim 10, wherein the connector housing comprises a top, bottom opposite the top, a first end, a second end opposite the first end, and opposed sides, and each of the first and second electrical cables extends out the first end, and the first at least one mounting portion and the second at least one mounting portion extend through the bottom.

12. The electrical cable connector as recited in claim 10, wherein the first terminal body comprises first and second opposed walls that are spaced from each other in a lateral direction perpendicular to the first direction and a bridge member connected between the first and second walls.

13. The electrical cable connector as recited in claim 11, further comprising an end wall configured to cover the second end and is removable from the connector housing.

14. The electrical cable connector as recited in claim 11, wherein the first surface of the first electrical terminal is spaced from the top a first distance, and the second surface of the second electrical terminal is spaced from the top a second distance that is greater than the first distance.

15. The electrical cable connector as recited in claim 10, wherein the first surface of the first electrical terminal is further spaced from the second surface of the second electrical terminal along a lateral direction perpendicular to the first direction.

16. The electrical cable connector as recited in claim 10, wherein the first electrical terminal has a first height in the first direction, the second electrical terminal has a second height in the first direction, and the first height is greater than the second height.

17. An electrical cable connector comprising:

an electrically insulative connector housing;

a first electrical cable including a first electrical conductor;

a second electrical cable including a second electrical conductor;

a first electrical terminal including a first terminal body capable of being mounted to the first electrical conductor, and a first at least one mounting portion that extends out from the first terminal body and out the connector housing in a first direction, wherein the first at least one mounting portion is configured to be mounted to a printed circuit board; and a second electrical terminal including a second terminal body capable of being mounted to the second electrical conductor, and a second at least one mounting portion that extends out from the second terminal body and out the connector housing in the first direction, wherein the second at least one mounting portion is configured to be mounted to the printed circuit board;

wherein the first electrical conductor is attached to the first electrical terminal and the second electrical conductor is attached to the second electrical terminal, and wherein the first electrical cable is offset from the second electrical cable in the first direction;

wherein:

the connector housing comprises a top, bottom opposite the top, a first end, a second end opposite the first end, and opposed sides, and each of the first and second electrical cables extend out the first end, and the first at least one mounting portion and the second at least one mounting portion extend through the bottom;

the first terminal body comprises a first surface and the first electrical conductor is mounted to the first surface of the first terminal body;

the second terminal body comprises a first surface and the second electrical conductor is mounted to the first surface of the second terminal body; and the first surface of the first electrical terminal is spaced from the top a first distance, and the first surface of the second terminal is spaced from the top a second distance that is greater than the first distance.

18. An electrical cable connector comprising:

an electrically insulative connector housing;

a first electrical cable including a first electrical conductor;

a second electrical cable including a second electrical conductor;

a first electrical terminal including a first terminal body capable of being mounted to the first electrical conductor, and a first at least one mounting portion that extends out from the first terminal body and out the connector housing in a first direction, wherein the first at least one mounting portion is configured to be mounted to a printed circuit board; and a second electrical terminal including a second terminal body capable of being mounted to the second electrical conductor, and a second at least one mounting portion that extends out from the second terminal body and out the connector housing in the first direction, wherein the second at least one mounting portion is configured to be mounted to the printed circuit board;

wherein the first electrical conductor is attached to the first electrical terminal and the second electrical conductor is attached to the second electrical terminal, and wherein the first electrical cable is offset from the second electrical cable in the first direction;

wherein the first terminal body comprises a first surface and a second surface opposite the first surface and spaced from the first surface in the first direction, the second terminal body comprises a first surface and a second surface opposite the first surface and spaced from the first surface in the first direction, the first electrical conductor is mounted to the first surface of the first electrical terminal, and the second electrical conductor is mounted to the second surface of the second electrical terminal;

wherein the connector housing comprises a top, bottom opposite the top, a first end, a second end opposite the first end, and opposed sides, and each of the first and second electrical cables extend out the first end, and the first at least one mounting portion and the second at least one mounting portion extend through the bottom;

wherein the first electrical terminal is disposed between the second end and the second electrical terminal, and the second electrical terminal is disposed between the first electrical terminal and the first end.

* * * * *